US011745495B2

(12) United States Patent
Tozuka

(10) Patent No.: US 11,745,495 B2
(45) Date of Patent: Sep. 5, 2023

(54) CORRUGATED PAPERBOARD PRINTER AND CORRUGATED PAPERBOARD BOX MAKING MACHINE

(71) Applicant: KABUSHiKi KAISHA ISOWA, Kasugai (JP)

(72) Inventor: Yusuke Tozuka, Nagoya (JP)

(73) Assignee: KABUSHIKI KAISHA ISOWA, Aichi (JP)

( * ) Notice: Subject to any disclaimer, the term of this patent is extended or adjusted under 35 U.S.C. 154(b) by 5 days.

(21) Appl. No.: 17/734,769

(22) Filed: May 2, 2022

(65) Prior Publication Data

US 2022/0363051 A1 Nov. 17, 2022

(30) Foreign Application Priority Data

May 13, 2021 (JP) ..... 2021-081539

(51) Int. Cl.
*B41F 31/04* (2006.01)
*B31B 50/88* (2017.01)
*B31B 120/70* (2017.01)

(52) U.S. Cl.
CPC ..... *B41F 31/04* (2013.01); *B31B 50/88* (2017.08); *B31B 2120/70* (2017.08)

(58) Field of Classification Search
CPC ..... B41F 31/04; B41F 5/24; B41F 31/027; B41F 31/05; B41F 31/06; B41F 31/20; B41F 33/10; B41F 33/14; B41F 35/00; B41F 35/04; B41P 2235/26
See application file for complete search history.

(56) References Cited

U.S. PATENT DOCUMENTS 3,630,146 A * 12/1971 Shields ..... B41F 31/04 101/169

FOREIGN PATENT DOCUMENTS

JP H10-296961 A 11/1998
JP 2011-037170 A 2/2011

* cited by examiner

*Primary Examiner* — Matthew G Marini
*Assistant Examiner* — Leo T Hinze
(74) *Attorney, Agent, or Firm* — Crowell & Moring LLP

(57) ABSTRACT

Disclosed is a corrugated paperboard printer comprising a pressing device for applying a pressing force to press a chamber which reserves ink toward an anilox roll. The pressing device is configured to apply a first pressing force, and a second pressing force which is greater than the first pressing force, respectively, to a first pressing area and a second pressing area in a back surface of a chamber frame. In a state in which no pressing force is applied by the pressing device, bending occurring in the chamber frame due to a load transmitted from a printing roll to the chamber frame via the anilox roll as printing is performed to a corrugated paperboard sheet is greater in the second pressing area than in the first pressing area.

10 Claims, 14 Drawing Sheets

CORRUGATED PAPERBOARD PRINTER AND CORRUGATED PAPERBOARD BOX MAKING MACHINE

RELATED APPLICATIONS

This application claims priority to Japanese Patent Application No. 2021-081539, filed on May 13, 2021, the entire content of which is incorporated herein by reference.

BACKGROUND OF THE INVENTION

1. Field of the Invention

The present invention relates to a corrugated paperboard printer, and a corrugated paperboard box making machine equipped with the corrugated paperboard printer.

2. Description of the Related Art

Heretofore, there has been known a chamber blade system, as a printing system for performing flexographic (flexo) printing to a corrugated paperboard sheet. For example, a flexo printer disclosed in JP-A H10-296961 (Patent Document 1) is configured to transfer ink from an ink reservoir of a chamber frame to an anilox roll, and flatten the transferred ink to a given thickness by means of a doctor blade attached to the chamber frame. The flexo printer is further configured to supply the ink transferred to the anilox roll, to a printing plate attached to a printing roll, and transfer the ink from the printing plate to a corrugated paperboard sheet, thereby performing printing.

SUMMARY OF THE INVENTION

Technical Problem

In a chamber blade-type flexo printer as disclosed in the Patent Document 1, during printing, the printing plate of the printing roll is pressed against a corrugated paperboard sheet being conveyed at a given speed, and therefore the printing roll is subjected to a load from the corrugated paperboard sheet. The load applied to the printing roll is transmitted from the printing roll to the anilox roll, the doctor blade and the chamber frame. Particularly, when the anilox roll is subjected to the load, it vibrates in a bending mode.

Meanwhile, a flexo printer, e.g., this type of flexo printer, needs to increase the width thereof (printer width), according to the size of a corrugated paperboard sheet, so that the width of each of the printing roll, the anilox roll, the chamber frame and some other printer members also becomes larger. When performing printing to a corrugated paperboard sheet having a certain level of thickness and rigidity, using such printer members having a relatively large width, each of the printer members such as the printing roll is subjected to a large load from the corrugated paperboard sheet, every time a plurality of the corrugated paperboard sheets are printed one by one. For example, a printer width-directional central portion of the anilox roll or chamber frame vibrates in a bending mode, so that a contact force between a distal end of the doctor blade and the anilox roll varies from moment to moment, and the thickness of ink transferred to the anilox rolls becomes uneven. As a result, the amount of ink adhered onto the printing plate of the printing roll becomes uneven, leading to a problem that unevenness occurs in printing to the corrugated paperboard sheet.

The present invention has been made to solve the above problem, and an object thereof is to provide a corrugated paperboard printer and a corrugated paperboard box making machine each capable of suppressing bending of a chamber frame to improve printing accuracy.

Solution to Technical Problem

The present invention provides a corrugated paperboard printer which comprises: a chamber which reserves ink; an anilox roll onto which the ink is transferred from the chamber; a printing roll provided with a printing plate, and configured to allow the ink to be transferred from the anilox roll onto the printing plate, and transfer the ink on the printing plate onto a corrugated paperboard sheet to print the corrugated paperboard sheet; and a pressing device configured to apply a pressing force to press the chamber toward the anilox roll; wherein the chamber comprises: a chamber frame which reserves the ink; and a doctor blade attached to the chamber frame and configured to scrape the ink transferred onto the anilox roll to adjust a thickness of the ink after the transfer; and wherein the pressing device is configured to apply a first pressing force, and a second pressing force which is greater than the first pressing force, respectively, to a first pressing area and a second pressing area in a back surface of the chamber frame, wherein in a state in which no pressing force is applied by the pressing device, bending occurring in the chamber frame due to a load transmitted from the printing roll to the chamber frame via the anilox roll as printing is performed to the corrugated paperboard sheet is greater in the second pressing area than in the first pressing area.

The present invention can be implemented not only as the corrugated paperboard printer, but also as, e.g., a corrugated paperboard box making machine equipped with the corrugated paperboard printer.

Effect of Invention

The corrugated paperboard printer and the corrugated paperboard box making machine of the present invention can suppress bending of the chamber frame to improve printing accuracy.

DETAILED DESCRIPTION OF THE PREFERRED EMBODIMENTS

With reference to the drawings, a corrugated paperboard box making machine according to one embodiment of the present invention will now be described. First of all, the overall configuration of the corrugated paperboard box making machine (hereinafter referred to as "box making machine") 10 will be described.

(Box Making Machine)

Figure 1:
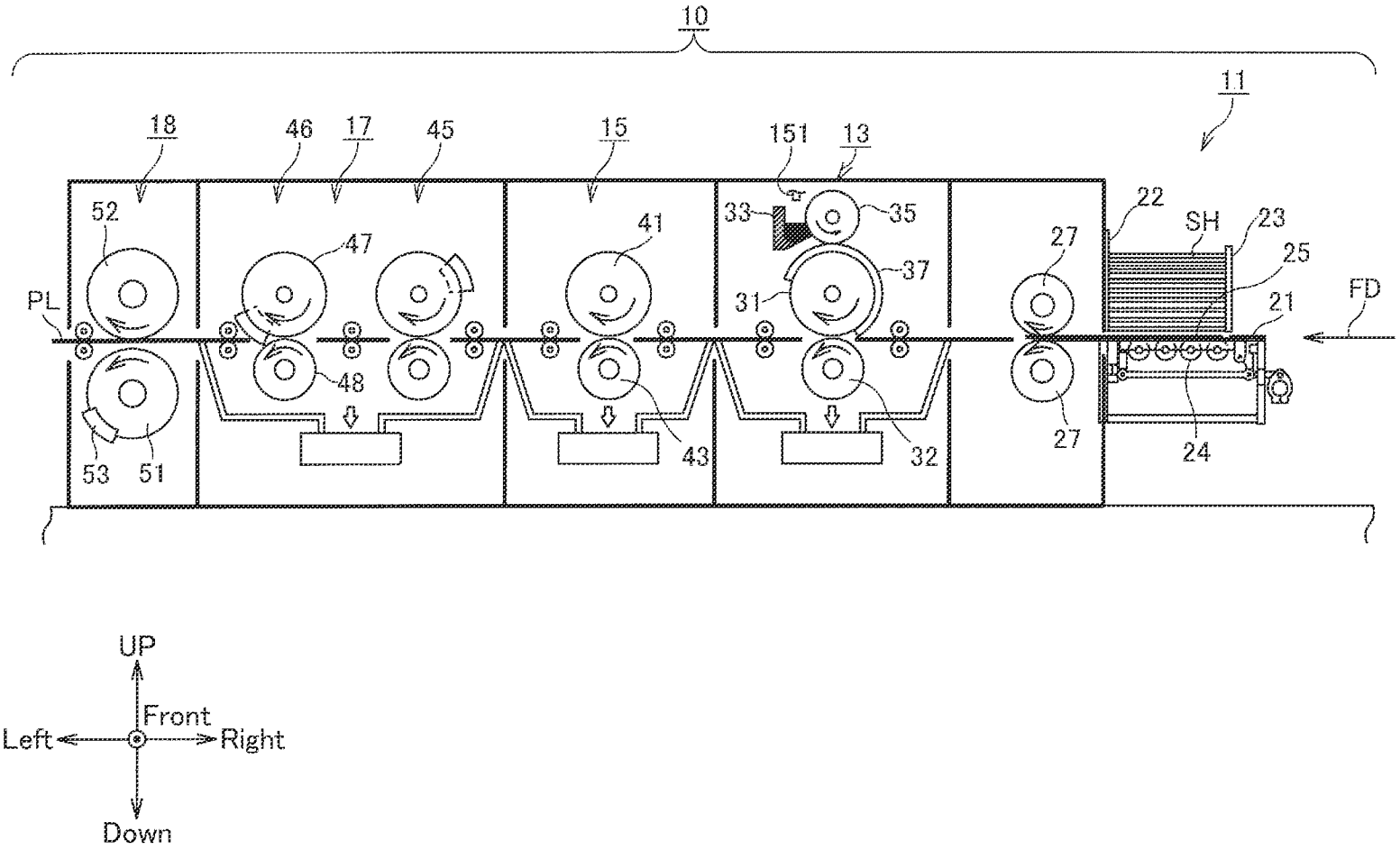
FIG. 1 is a schematic front view showing the overall configuration of a corrugated paperboard box making machine according to one embodiment of the present invention.

With reference to FIG. 1, the overall configuration of the box making machine 10 will be described. As shown in FIG. 1, the box making machine 10 conveys corrugated boards SH along a conveyance path PL in a conveyance direction FD (in a right-to-left direction in FIG. 1) and performs printing and processing to the corrugated boards SH. The following description will be made based on a direction along which the box making machine 10 is viewed rearwardly from the front side thereof, as shown in FIG. 1. That is, in the following description, the upstream side and down stream side of the conveyance direction FD will be referred to respectively as "right side" and "left side", and the near side and far side in a width direction of the box making machine 10 will be referred to respectively as "front side" and "rear side". Further, a direction orthogonal to the right-left direction the front-rear direction will be referred to as "up-down direction". The up-down direction corresponds to, e.g., a direction orthogonal to the plane of a corrugated board SH being conveyed in the conveyance direction FD.

The box making machine 10 comprises, in order from the upstream side in the conveyance direction FD (the right side), a corrugate paperboard feeder (hereinafter referred to as "feeder") 11, a corrugated paperboard printer (hereinafter referred to as "printer") 13, a creaser 15, a slotter 17, and a die-cutter 18. In this embodiment, the feeder 11 is a device for feeding out a plurality of corrugated paperboard sheets SH stacked in the up-down direction, one-by-one. The feeder 11 comprises a table 21, a front gate 22 and a back guide 23, wherein a plurality of corrugated paperboard sheets SH are stacked and held on the table 21 in a space between the front gate 22 and the back guide 23. The feeder 11 further comprises a plurality of feeding rollers 24, a liftable-lowerable grate 25, and a pair of feed rolls 27. When the grate 25 is lowered with respect to the plurality of feeding rollers 24, the plurality of feeding rollers 24 are brought into contact with a lowermost one of the plurality of corrugated paperboard sheets SH, thereby feeding out the corrugated paperboard sheets SH one-by-one toward the pair of feed rolls 27. The pair of feed rolls 27 are rotated while nipping each of the corrugated paperboard sheets SH therebetween, thereby feeding out the corrugated paperboard sheets SH toward the printer 13.

The printer 13 is a device for performing printing to each of the corrugated paperboard sheets SH. The printer 13 comprises a printing roll 31, a press roll 32, a chamber 33, and anilox roll 35. The printing roll 31 is disposed at a position opposed to the press roll 32 while interposing the conveyance path PL therebetween in the up-down direction. The printing roll 31 is configured to allow a printing plate 37 to be attached to an outer peripheral surface thereof. The printing plate 37 is attached to the printing roll 31, e.g., by wrapping it along the outer peripheral surface of the printing roll 31, and engaging opposite ends thereof in a circumferential direction of the printing roll 31 with an engagement part of the printing roll 31. The chamber 33 is a device for reserving ink and supplying the ink to the anilox roll 35. The anilox roll 35 functions as an ink transfer roll for supplying the ink transferred from the chamber 33 to the printing plate 37 of the printing roll 31, The creaser 15 is a device for creasing each of the corrugated paperboard sheets SH. The creaser 15 comprises an upper creasing roll 41 and a lower creasing roll 43 which are arranged across the conveyance path PL in the up-down direction. The upper creasing roll 41 and the lower creasing roll 43 are configured to be rotated to form a crease line at a desired position of the corrugated paperboard sheet SH being conveyed.

The slotter 17 is a device for performing slotting (slot machining) to each of the corrugated paperboard sheets SH. The slotter 17 has a double slotter-type configuration comprising a first slotter subunit 45 disposed on the upstream side in the conveyance direction FD, and a second slotter subunit 46 disposed on the downstream side in the conveyance direction FD. Each of the first and second slotter subunits 45, 46 comprises an upper slotter roll 47 and a lower slotter roll 48 which are arranged while interposing the conveyance direction FD therebetween in the up-down direction. A slotter blade is attached to the upper slotter roll 47, and the lower slotter roll 48 is formed with a groove capable of fittingly receiving the slotter blade therein. The upper slotter roll 47 and the lower slotter roll 48 are configured to cut a slot at a desired position of each of the corrugated paperboard sheets SH being conveyed.

The die-cutter 18 is a device for performing punching to each of the corrugated paperboard sheets SH. The die-cutter 18 comprises a die cylinder 51 and an anvil cylinder 52 which are arranged across the conveyance path PL in the up-down direction. A punching die 53 for punching each of the corrugated paperboard sheets SH is attached to a plate-shaped member such as a veneer board, and then the plate-shaped member is wrappingly attached to an outer peripheral surface of the die cylinder 51 disposed on the lower side. The punching die 53 is configured to punch out a part of each of the corrugated paperboard sheets SH being continuously conveyed, at a desired position.

The box making machine 10 illustrated in FIG. 1 is shown as one example. For example, the box making machine 10 may comprise a plurality of printers 13, and may be configured to perform multicolor printing in a single conveyance. Further, the box making machine 10 may comprise at least one processing unit among various processing units such as the creaser 15, the slotter 17 and the die-cutter 18. Further, the box making machine 10 may comprise any additional processing unit for performing processing to each of the corrugated boards SH. For example, the box making machine 10 may be provided with, on the downstream side of the die-cutter 19, a folder-gluer for folding and gluing each of the corrugated paperboard sheets processed by the processing unit disposed upstream thereof; and a counter-ejector for counting the corrugated paperboard sheets fed out from the folder-gluer to form a batch of a given number of corrugated paperboard sheets and eject the batch to a subsequent bundling machine. A basis configuration of the folder-gluer is publicly known as disclosed in, e.g., JP-A 2016-153201. A basis configuration of the counter-ejector is also publicly known as disclosed in, e.g., JP-A 2011-230432.

(Printer)

Figure 2:
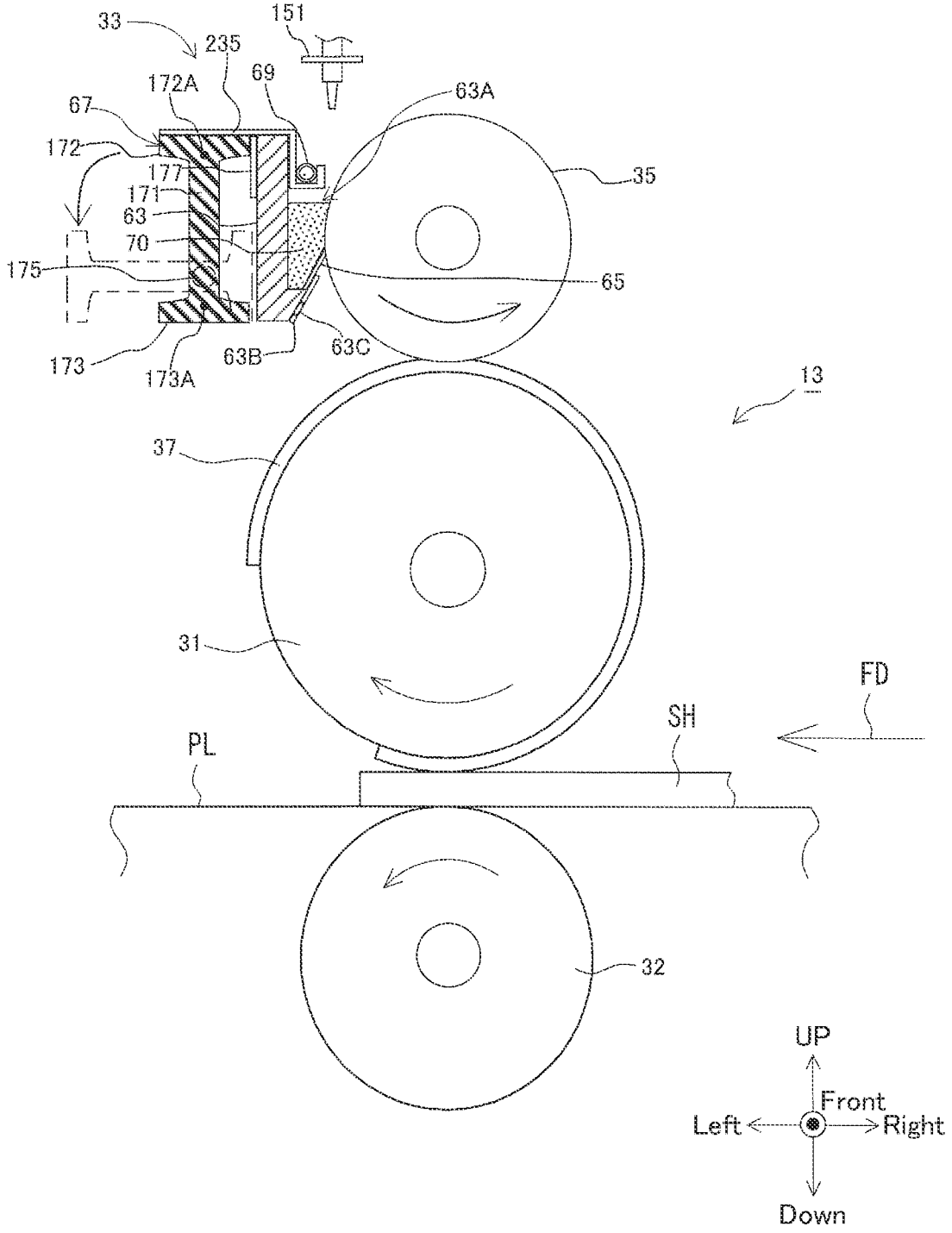
FIG. 2 is a schematic front view showing a corrugated paperboard printer in this embodiment.
Figure 3:
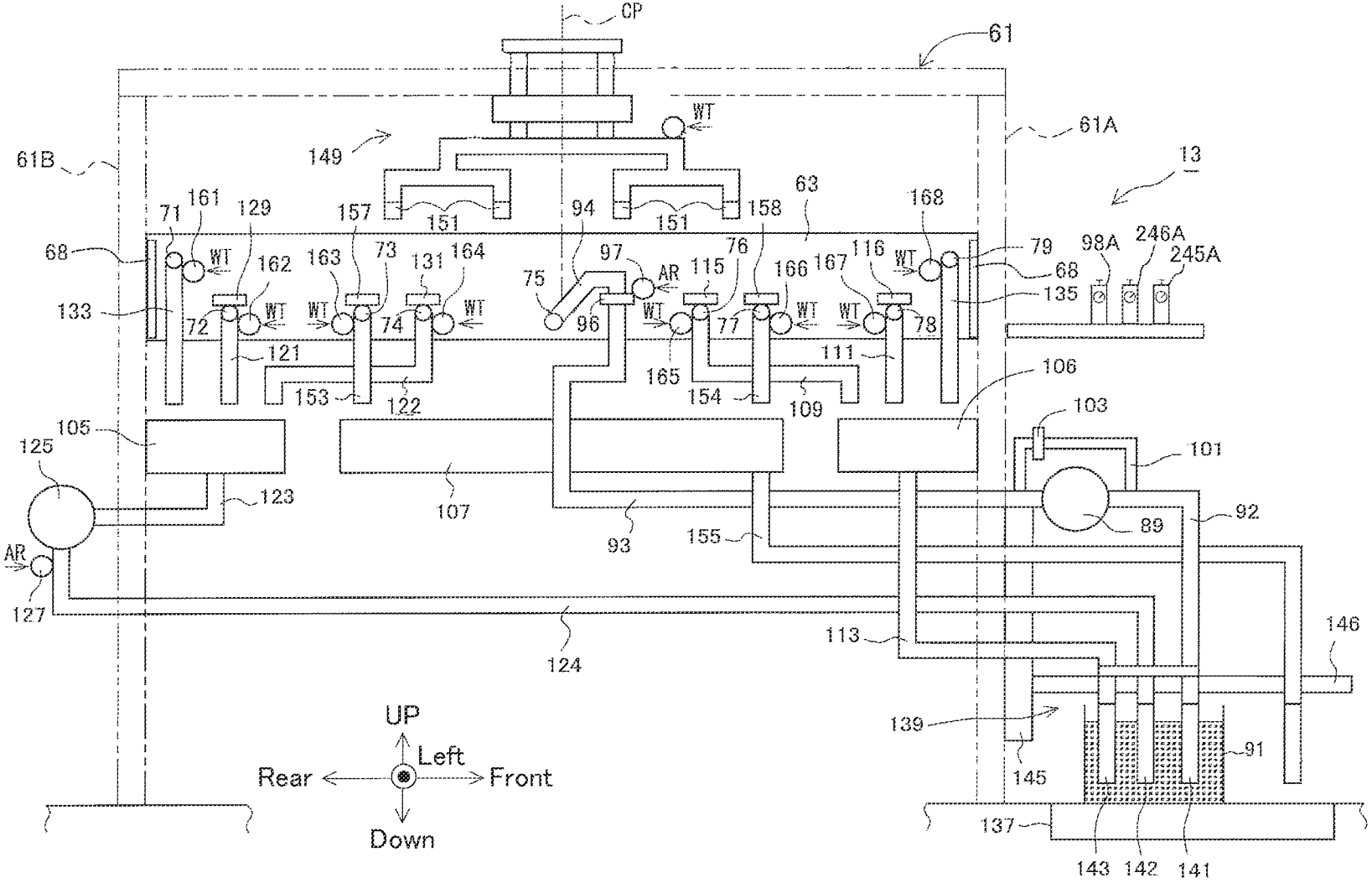
FIG. 3 is a schematic left side view of the corrugated paperboard printer in this embodiment.
Figure 4:
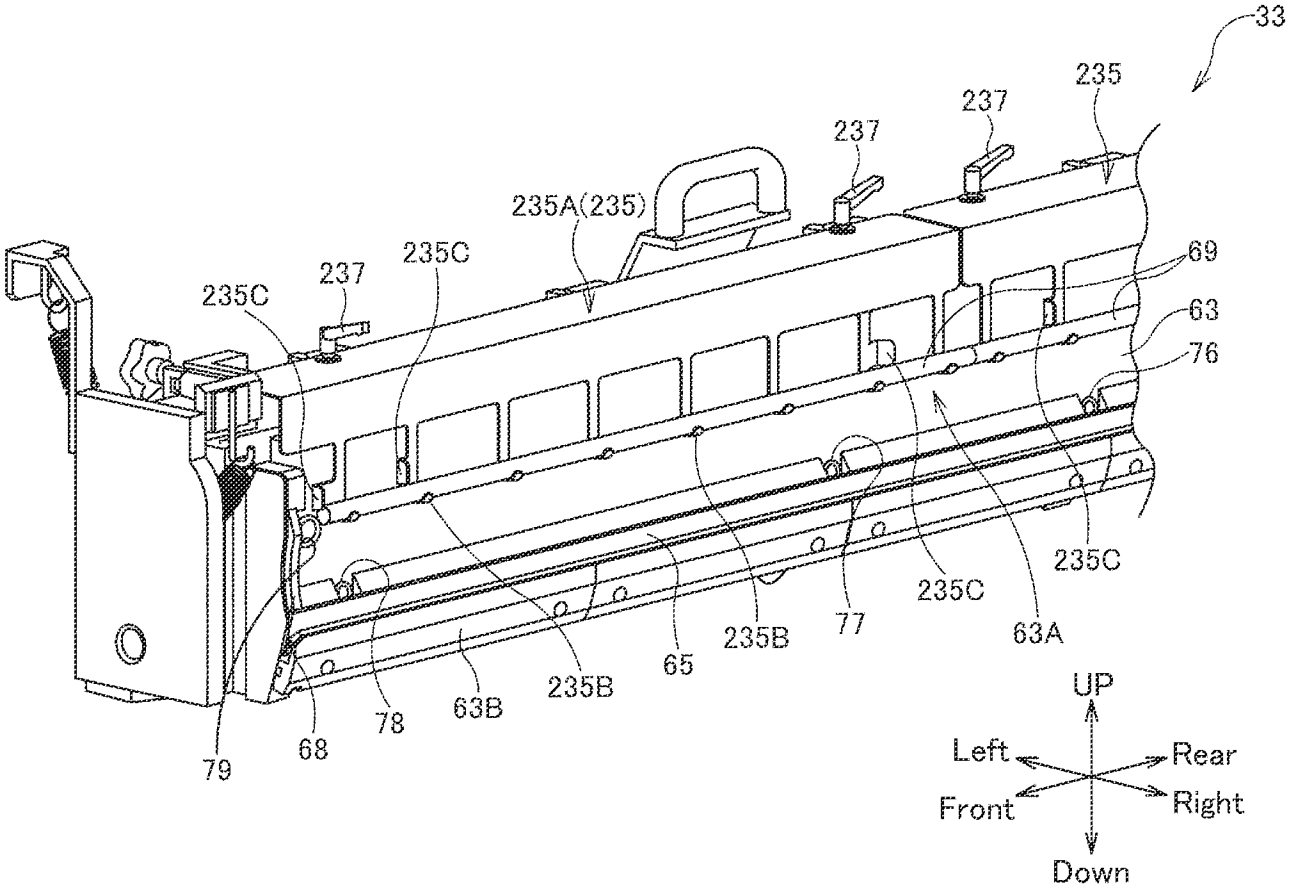
FIG. 4 is a perspective view of a chamber of the printer in this embodiment, when viewed obliquely rearwardly and downwardly from the front upper side on the right side thereof.

With reference to FIGS. 2 to 4, the printer 13 will be described. Note that in FIG. 3, illustration of some components such as the after-mentioned steel member 67 and air cylinders 251 (see FIG. 6) are omitted for the purpose of avoiding complexity of the drawing. As shown in FIGS. 2 to 4, the printer 13 comprises a printer housing 61 in which the aforementioned chamber 33, etc., are housed. In this embodiment, the anilox roll 35 is composed of a metal member formed in a circular cylindrical shape extending along the front-rear direction. The anilox roll 35 has a front end and a rear end which are supported, respectively, by a front printer frame 61A located on the front side of the printer housing 61 and a rear printer frame 61B located on the rear side of the printer housing 61, in such a manner as to be rotatable about a rotational axis along the front-rear direction.

The chamber 33 comprises a chamber frame 63, a doctor blade 65, a steel member 67 and a rod member 69. The chamber frame 63 is a frame-shaped member extending along the front-rear direction, and is formed such that an ink reservoir 63A for reserving ink 70 is defined on the right side (upstream side) thereof. For example, the ink 70 is flexo ink. FIG. 2 shows a state in which the ink 70 is reserved in the ink reservoir 63A.

The chamber frame 63 has a lower end provided with a mounting member 63B for fixing the doctor blade 65. The doctor blade 65 is replaceably fixed to the mounting member 63B by a screwing member 63C such as a bolt. In this embodiment, the doctor blade 65 is composed of a single thin plate extending along the front-rear direction. In this embodiment, the doctor blade 65 is fixed to the mounting member 63B (chamber frame 63) such that a distal end thereof in its width direction (in a lower left-to-upper right direction) is in contact with an outer peripheral surface of the anilox roll 35. The doctor blade 65 scrapes the ink 70 transferred from the ink reservoir 63A to the anilox roll 35 to adjust the thickness of the transferred ink 70 adhered on the outer peripheral surface of the anilox roll 35 to a desired value.

Further, a pair of dam plates 68 are attached, respectively, to opposite ends of the chamber frame 63 in the front-rear direction. The pair of dam plates 68 are arranged to come into contact, respectively, with opposite ends of each of the anilox roll 35 and the doctor blade 65 in the front-rear direction, to prevent the ink 70 reserved in the ink reservoir 63A from flowing out from the front-rear directional opposite ends, thereby keeping reserving the ink 70 in the ink reservoir 63A. Thus, the ink reservoir 63A in this embodiment is a space which is surrounded by a right surface of the chamber frame 63, the outer peripheral surface of the anilox roll 35, the doctor blade 65 and the pair of dam plates 68, and is long in the front-rear direction.

(Supply, Recovery and Cleaning of Ink)

With reference to FIGS. 3 and 4, supply, recovery and cleaning of the ink 70 will be described. As shown in FIGS. 3 and 4, the chamber frame 63 is formed with a plurality of (in this embodiment, nine) coupling ports 71, 72, 73, 74, 75, 76, 77, 78, 79.

The coupling ports 71 to 79 are formed in this order in a rear-to-front direction. In this embodiment, each of the nine coupling ports 71 to 79 is formed in a cylindrical shape, to penetrate through the chamber frame 63 along the right-left direction and connect the left side (downstream side in the conveyance direction FD) of the chamber frame 63 and the ink reservoir 63A on the right side of the chamber frame 63.

Figure 5:
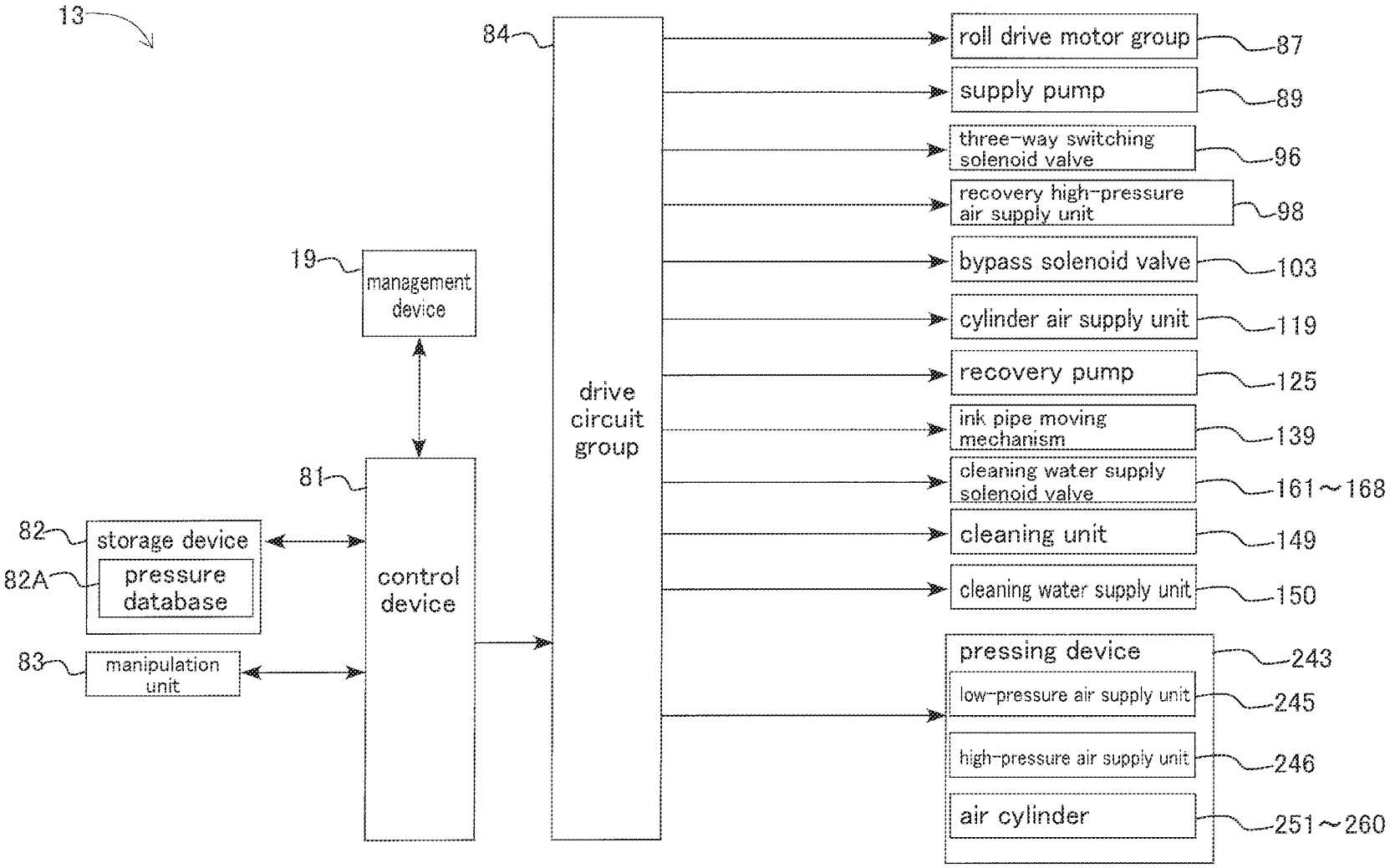
FIG. 5 is a block diagram showing an electrical configuration of the printer in this embodiment.

As shown in FIG. 5, the printer 13 comprises a control device 81, a storage device 82, a manipulation unit 83, and a drive circuit group 84. In this embodiment, the control device 81 is composed of a CPU-based computer, and operable to comprehensively control the printer 13. The storage device 82 is composed of a memory or the like, and stores therein various data and programs for the printer 13. The control device 81 is operable to execute the programs stored in the storage device 82 to control the operation of the printer 13.

In this embodiment, the manipulation unit 83 is composed of a touch panel, and operable, based on control of the control device 81, to display various pieces of information. The manipulation unit 83 is also operable to output, to the control device 81, a signal corresponding to a manipulated input accepted from a user of a factory in which the box making machine 10 is installed. The drive circuit group 84 is composed of a plurality of drive circuits for driving various devices such as a roll drive motor group 87 described in detail later, and operable, based on control of the control device 81, to control the operations of the various devices. In this embodiment, the control device 81 is operable to receive control information for executing each order, from a management device 19 for managing the entire operation of the box making machine 10, and perform printing associated with each order, according to the control information. In this embodiment, the roll drive motor group 87 is composed of a plurality of motors for rotating the printing roll 31, the press roll 32 and the anilox roll 35, respectively. The control device 81 is operable to control the roll drive motor group 87 through the drive circuit group 84, thereby controlling rotation of the printing roll 31 and others so as to perform printing.

As shown in FIG. 3, the coupling port 75 is formed at a middle position CP of the chamber frame 63 in the front-rear direction. The coupling port 75 is used for supply the ink 70 to the ink reservoir 63A and recovery of the ink 70 from the ink reservoir 63A. A supply pump 89 and an ink can 91 are arranged on the front side of the front printer frame 61A. In this embodiment, the control device 81 is operable to execute control of rotating the supply pump 89 in a normal direction (i.e., normally rotating the supply pump 89), thereby supplying the ink 70 reserved in the ink can 91, to the coupling port 75 via ink supply pipes 92, 93, 94. Further, the ink supply pipes 92, 93, 94 are constructed by connecting one or more permeable hoses and one or more metal pipes together. The control device 81 is also operable to execute control of rotating the supply pump 89 in a reverse direction (i.e., reversely rotating the supply pump 89), thereby recovering the ink 70 reserved in the ink reservoir 63A, to the ink can 91 via the ink supply pipes 92, 93, 94.

The supply pump 89 is connected to the coupling port 75 via the ink supply pipes 93, 94. A three-way switching solenoid valve 96 is inserted between the ink supply pipes 93, 94. The three-way switching solenoid valve 96 is configured to be switched, based on control of the control device 81, between a state in which it connects the coupling port 75 and the ink supply pipe 93 (supply pump 89) and a state in which it connects a high-pressure air supply solenoid valve 97 and the ink supply pipe 93. For example, during recovery of the ink 70, the control device 81 is operable, after executing control of rotating the supply pump 89 in the reverse direction to recover the ink 70 to the ink can 91, to control a recovery high-pressure air supply unit 98 (see FIG. 5) to send high-pressure air into the ink supply pipe 93, thereby discharging and recovering the ink 70 remaining in the ink supply pipes 92, 93 to the ink can 91. In this process, the control device 81 is operable to execute control of opening a bypass solenoid valve 103 inserted in a bypass pipe 101 connecting the ink supply pipes 92, 93 while bypassing the supply pump 89, thereby discharging the ink 70 to the ink can 91 via the bypass pipe 101. This makes it possible to suppress an increase in load on the supply pump 89 or failure of the supply pump 89 due to feeding of the high-pressure air.

In this embodiment, the coupling ports 71 to 74 are formed at positions symmetrical, respectively, to the coupling ports 76 to 79, about the coupling port 75 in the front-rear direction. Further, the coupling ports 72 to 78 are formed at the same height positions in the up-down direction. The coupling ports 72 to 78 are used for recovery of the ink 70 in the ink reservoir 63A. The printer 13 is provided with two recovery pans 105, 106, and a cleaning pan 107. The recovery pan 105, the cleaning pan 107 and the recovery pan 106 are arranged side by side in this order in the rear-to-front direction.

Figure 7:
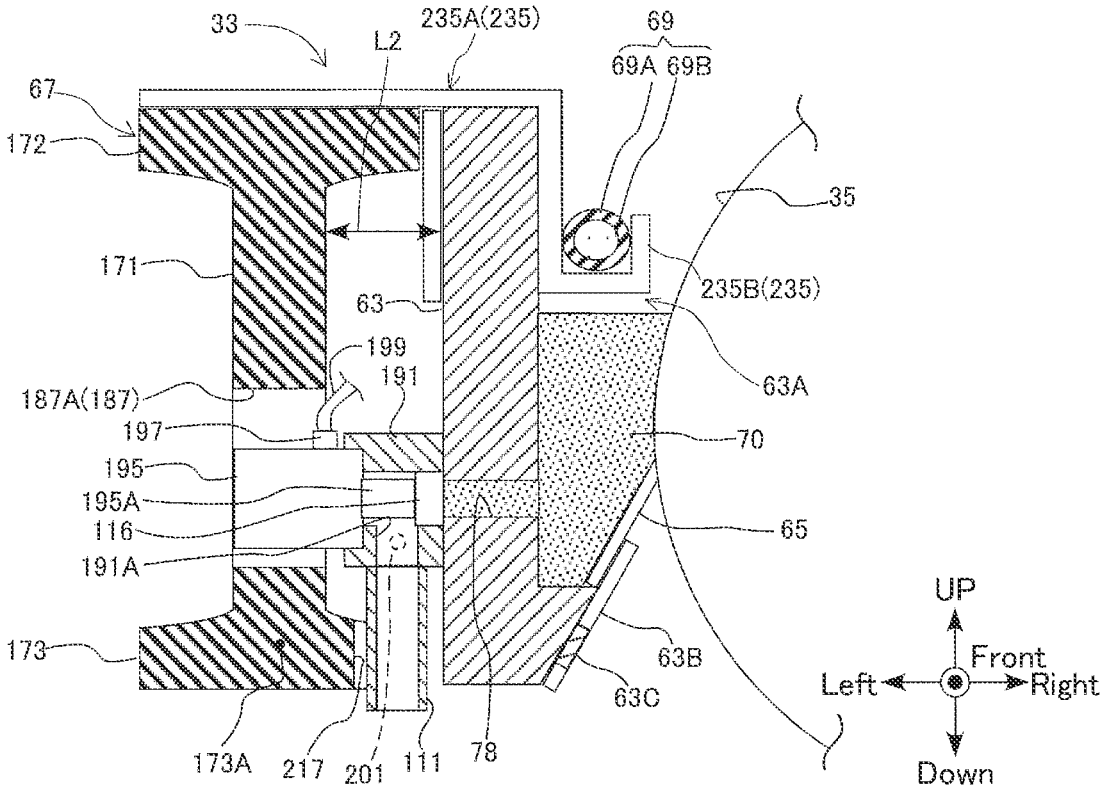
FIG. 7 is a sectional view of the chamber, taken along the line A-A in FIG. 6.

Each of the coupling ports 76, 78 on the front side of the printer 13 is configured to discharge the ink 70 in the ink reservoir 63A to the recovery pan 106 via a corresponding one of two recovery pipes 109, 111. The recovery pan 106 is configured to discharge the received ink 70 to the ink can 91 via a recovery pipe 113. The chamber frame 63 is further provided with two coupling port valves 115, 116 each for selectively opening and closing a corresponding one of the coupling ports 76, 78. Each of the coupling port valves 115, 116 is operable, in response to driving the after-mentioned air cylinder (specifically, the after-mentioned coupling port valve-actuating air cylinder 195 as illustrated in FIG. 7), to switch between open and closed states of a corresponding one of the coupling ports 76, 78. The printer 13 comprises a cylinder air supply unit 119 (see FIG. 5) for driving respective air cylinders (the coupling port valves 115, 116 and the after-mentioned coupling port valves 129, 157, 131, 158) of the coupling ports 72, 73, 74, 76, 77, 78 including the above-mentioned coupling ports 76, 78.

In this embodiment, the cylinder air supply unit 119 comprises: an air compressor for generating compressed air; a pressure reducing valve for reducing the pressure of the compressed air to a value usable for driving the air cylinders of the coupling port valves such as the coupling port valve 115; and a solenoid valve for switching supply of pressure-reduced air to each of the air cylinders. The control device 81 is operable, when reserving the ink 70 in the ink reservoir 63A to perform printing, to control the cylinder air supply unit 119 to keep all the coupling port valves including the coupling port valves 115, 116 in a closed state. The control device 81 is also operable, when recovering the ink 70 in the ink reservoir 63A, to control the cylinder air supply unit 119 to keep all the coupling port valves including the coupling port valves 115, 116 in an open state.

As with the coupling ports 76, 78 on the front side of the printer 13, each of the coupling ports 72, 74 on the rear side of the printer 13 is configured to discharge the ink 70 in the ink reservoir 63A to the recovery pan 105 via a corresponding one of two recovery pipes 121, 122. The discharge structure for the coupling ports 72, 74 is similar to that for the coupling ports 76, 78, and therefore description about common parts therebetween will be omitted. The recovery pan 105 is configured to discharge the received ink 70 to the ink can 91 via two recovery pipes 123, 124. A recovery pump 125 is inserted between the recovery pipes 123, 124. The control device 81 is operable, during recovery of the ink 70, to control the recovery pump 125 to discharge the ink 70 in the recovery pipes 123, 124 to the ink can 91. The control device 81 is also operable to allow high-pressure air to be supplied from the recovery high-pressure air supply unit 98 to the recovery pipe 124 via a high-pressure air supply solenoid 127, thereby discharging and recovering the ink 70 remaining in the recovery pipe 124 to the ink can 91 according to rotation of the recovery pump 125, as in the ink supply pipe 93. This makes it possible to more reliably recover, to the ink can 91 provided on the front side of the printer 13, the ink 70 in the recovery pan 105 disposed at a position far from the ink can 91, and the recovery pipes 123, 124 connected to the recovery pan 105. The control device 81 is operable to control the cylinder air supply unit 119 to control respective air cylinders of two coupling port valves 129, 131 attached, respectively, to the coupling ports 72, 74, thereby controlling opening and closing of the coupling ports 72, 74, in a similar manner to that for the coupling ports 76, 78.

The coupling ports 71, 79 are formed, respectively, in upper areas of the front-rear directional opposite end of the chamber frame 63. The coupling port 71 is configured to discharge the ink 70 in the ink reservoir 63A to the recovery pan 105 via a surplus ink recovery pipe 133. Similarly, the coupling port 79 is configured to discharge the ink 70 in the ink reservoir 63A to the recovery pan 106 via a surplus ink recovery pipe 135. Each of the coupling ports 71, 79 are kept in an open state. Thus, when the ink 70 supplied to the ink reservoir 63A is reserved to reach the height position of the coupling ports 71, 79, further supplied ink will be recovered as surplus ink to the recovery pans 105, 106 via the surplus ink recovery pipes 133, 135. In other words, each of the coupling ports 71, 79 is formed at a position where the liquid level of the ink 70 becomes highest when the ink 70 is reserved in the ink reservoir 63A.

The printer 13 in this embodiment further comprises a cleaning mechanism for cleaning the ink 70. The printer 13 performs cleaning of the ink 70 after completion of the above-mentioned recovery of the ink 70, e.g., in conjunction with change in the type of ink 70. As shown in FIG. 3, a drain channel 137 for discharging cleaning water WT is provided under the ink can 91. The drain channel 137 is buried under a floor on which the printer 13 is installed.

The printer 13 further comprises an ink pipe moving mechanism 139. The ink pipe moving mechanism 139 is operable to move respective open end sections 141, 142, 143 of the ink supply pipe 92, the recovery pipe 124 and the recovery pipe 113. The ink pipe moving mechanism 139 has a heretofore-known configuration which comprises an up-down guide member 145 and a front-rear guide member 146, wherein it is operable to integrally move the open end sections 141, 142, 143 along each of the up-down guide member 145 and the front-rear guide member 146. The control device 81 is operable to control the ink pipe moving mechanism 139 to move the open end sections 141, 142, 143 to a selected one of a plurality of positions. In this embodiment, the plurality of positions include: a lowered position where the open end sections 141, 142, 143 are lowered (moved downwardly) until entering the inside of the ink can 91; a raised position where the open end sections 141, 142, 143 are raised (moved upwardly) to a given distance from an upper end of the ink can 91; and a drain position where the open end sections 141, 142, 143 are moved forwardly to face the drain channel 137.

The printer 13 further comprises a cleaning unit 149, and a cleaning water supply unit 150 (which is not illustrated in FIG. 3 (see FIG. 5)). The cleaning unit 149 is disposed just above the ink reservoir 63A. The cleaning unit 149 is configured to be movable in the front-rear direction and the up-down direction, based on control of the control device 81. For example, during the recovery of the ink 70, the control device 81 is operable to execute control of moving and disposing the open end sections 141, 142, 143 to and at the raised position. Then, upon completion of the control of recovering the ink 70, the control device 81 is operable to control the ink pipe moving mechanism 139 to move the open end sections 141, 142, 143 to the drain position, and start a cleaning operation.

The cleaning water supply unit 150 is operable, upon start of the cleaning operation, to supply the cleaning water WT to the cleaning unit 149, based on control of the control unit 81. The cleaning unit 149 is provided with a plurality of nozzles 151 each opened downwardly. The cleaning unit 149 is operable to spray the cleaning water WT from the nozzles 151 to the ink reservoir 63A and the anilox roll 35, based on control of the control unit 81. The control device 81 is operable to execute control of cleaning the ink 70 adhered onto the ink reservoir 63A and the anilox roll 35, while moving the cleaning unit 149. Here, a liquid for cleaning the ink reservoir 63A and the anilox roll 35 is not limited to water, but may be any other suitable liquid such as a liquid cleanser or detergent with enhanced detergency against the ink 70

Each of the coupling ports 73, 77 is configured to discharge the cleaning water WT after cleaning (drainage water) to a cleaning pan 107 via a corresponding one of two drain pipes 153, 154. The cleaning pan 107 is configured to discharge the received cleaning water WT to the drain channel 137 via a drain pipe 155. The control device 81 is operable, during the cleaning operation by the cleaning unit 149, to execute control of opening two coupling port valves 157, 158 attached, respectively, to the coupling ports 73, 77, thereby discharging the cleaning water WT to the cleaning pan 107. The coupling port valves 157, 158 are controlled through the cylinder air supply unit 119.

Each of the coupling ports 71, 72, 73, 74, 76, 77, 78, 79, except for the coupling port 75, is provided with a corresponding one of eight cleaning water supply solenoid valves 161, 162, 163, 164, 165, 166, 167, 168. In this embodiment, the cleaning water supply unit 150 is connected to each of the surplus ink recovery pipes 133, 135, the recovery pipes 109, 111, 121, 122 and the drain pipes 153, 154 via a respective one of eight cleaning water pipes 201 (see FIG. 8), to supply the cleaning water WT to the surplus ink recovery pipes 133, 135 and others via the cleaning water pipes 201. The cleaning water supply solenoid valves 161 to 168 are attached, respectively, to the cleaning water pipes 201. In this embodiment, each of the cleaning water supply solenoid valves 161 to 168 is installed in the cleaning water pipe at a position close to the cleaning water supply unit 150 (at a position far from the chamber frame 63). In FIG. 3, the cleaning water supply solenoid valves 161 to 168 are illustrated on the chamber frame 63 for the sake of explanation. The installation position of each of the cleaning water supply solenoid valves 161 to 168 is not limited to a position close to the cleaning water supply unit 150, but may be a back surface of the chamber frame 63.

The control device 81 is operable, when cleaning the inside of the recovery pipes (e.g., the surplus ink recovery pipe 133) connected, respectively, to the coupling ports (e.g., the coupling port 71), to execute control of opening the cleaning water supply solenoid valves 161 to 168. That is, the control device 81 is operable to execute control of supplying the cleaning water to the recovery pipes (e.g., the surplus ink recovery pipe 133) from the cleaning water supply unit 150 via the cleaning water supply solenoid valves 161 to 168. The cleaning water supplied to the recovery pipes (e.g., the surplus ink recovery pipe 133) is discharged to the drain channel 137 via the recovery pipes (e.g., the recovery pipe 123). This makes it possible to clean the recovery pipes (e.g., the surplus ink recovery pipe 133) connected, respectively, to the coupling ports (e.g., the coupling port 71), individually.

(Steel Member)

Next, the steel member 67 will be described. As shown in FIG. 2, in this embodiment, the steel member 67 is composed of an I-section steel, wherein it has: a web 171 extending in the up-down direction of the chamber 33 in FIG. 2; a first flange 172 connected to an upper end of the web 171; and a second flange 173 connected to a lower end of the web 171. The shape and size of the I-section steel as the steel member 67 are defined by industrial standards such as JIS G3192. The steel member used for this embodiment is not limited to the I-section steel, but may be a steel member having any other suitable shape or configuration, such as an H-section steel.

Figure 6:
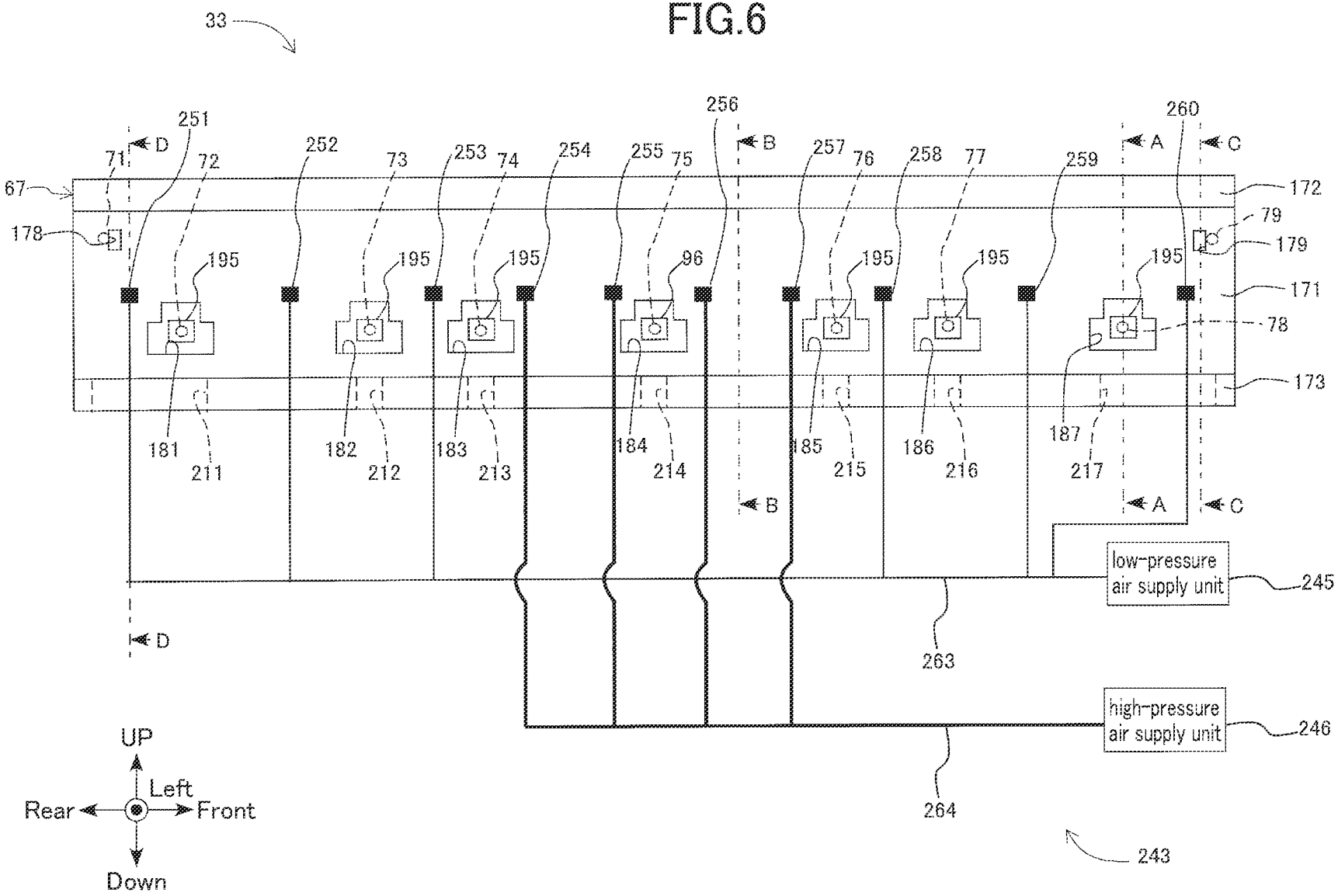
FIG. 6 is a schematic left side view of the chamber of the printer in this embodiment, wherein a steel member is attached to the chamber.

As shown in FIGS. 2 and 6, the steel member 67 is composed of a single member extending in the front-rear direction. The web 171 is formed in a plate-like shape extending in the front-rear direction while keeping an up-down directional width constant. The web 171 is disposed to extend from an upper end and a lower end of the chamber frame 63 in the up-down direction, and has a given thickness in the right-left direction. Each of the first flange 172 and the second flange 173 is formed in a plate-like shape extending in the front-rear direction while keeping a right-left directional width constant. The upper end of the web 171 is fixed to an intermediate portion 172A of the first flange 172 in the right-left direction. The intermediate portion 172A corresponds to a middle point of the first flange 172 in the right-left direction. On the other hand, the lower end of the web 171 is fixed to an intermediate portion 173A of the second flange 173 in the right-left direction. The intermediate portion 173A corresponds to a middle point of the second flange 173 in the right-left direction. Each of the first flange 172 and the second flange 173 is connected to the web 171 in a state in which it extends along in a direction orthogonal to the web 171.

The steel member 67 is configured such that a rotary shaft 175 (see FIG. 9) provided at a front end thereof is supported by the front printer frame 61A (see FIG. 3), and a rotary shaft 175 provided at a rear end thereof is supported by the rear printer frame 61B. The steel member 67 is supported by the front printer frame 61A and the rear printer frame 61B in such a manner as to be rotatably about an axis along the pair of the rotary shafts 175. In this embodiment, each of the rotary shafts 175 is provided in the vicinity of the lower end of the web 171 (see FIG. 2), and attached to the steel member 67 such that it protrudes outwardly in the front-rear direction (see FIG. 9). In this embodiment, the steel member 67 is configured to be rotatable about the rotary shafts 175 between the position illustrated in FIG. 2, i.e., a position where printing is performed (hereinafter referred to as "printing position"), and a maintenance position rotated by 90 degrees in a counterclockwise direction in FIG. 2 (see the arrowed line in FIG. 2) from the printing position (the maintenance position is indicated by the two-dot chain line in FIG. 2). The chamber frame 63 is fixed to the steel member 67 by a metal member 177. The chamber 33 comprising the chamber frame 63 and the rod member 69 is configured to be rotated about the rotary shafts 175. A user can rotate the chamber 33 to the maintenance position to perform replacement of the doctor blade 65, or other maintenance.

As shown in FIG. 6, the web 171 is formed with two cutouts 178, 179. Each of the cutouts 178, 179 is formed to penetrate through the web 171. Each of the cutouts 178, 179 is formed to reduce interference between the web 171 and the cleaning water pipe 201 (see FIG. 8) for supplying the cleaning water WT to each of the surplus ink recovery pipes 133, 135. Thus, each of the cutouts 178, 179 is formed in accordance with, e.g., a position where the cleaning water pipe 201 is connected to each of the surplus ink recovery pipes 133, 135, or a position where the cleaning water pipe 201 is bent, and formed to allow a part of the cleaning water pipe 201 to be inserted thereinto.

The web 171 is also formed with seven maintenance openings 181, 182, 183, 184, 185, 186, 187. The maintenance openings 181 to 187 are formed in accordance with the respective positions of the coupling ports 72 to 78 (see FIG. 3), and arranged side by side in the front-rear direction at positions having the same height in the up-down direction. The maintenance openings 181 to 187 have the same configuration. Therefore, in the following description, the frontmost maintenance opening 187 will be mainly described, and description of the remaining maintenance openings 181 to 186 will be appropriately omitted.

Figure 8:
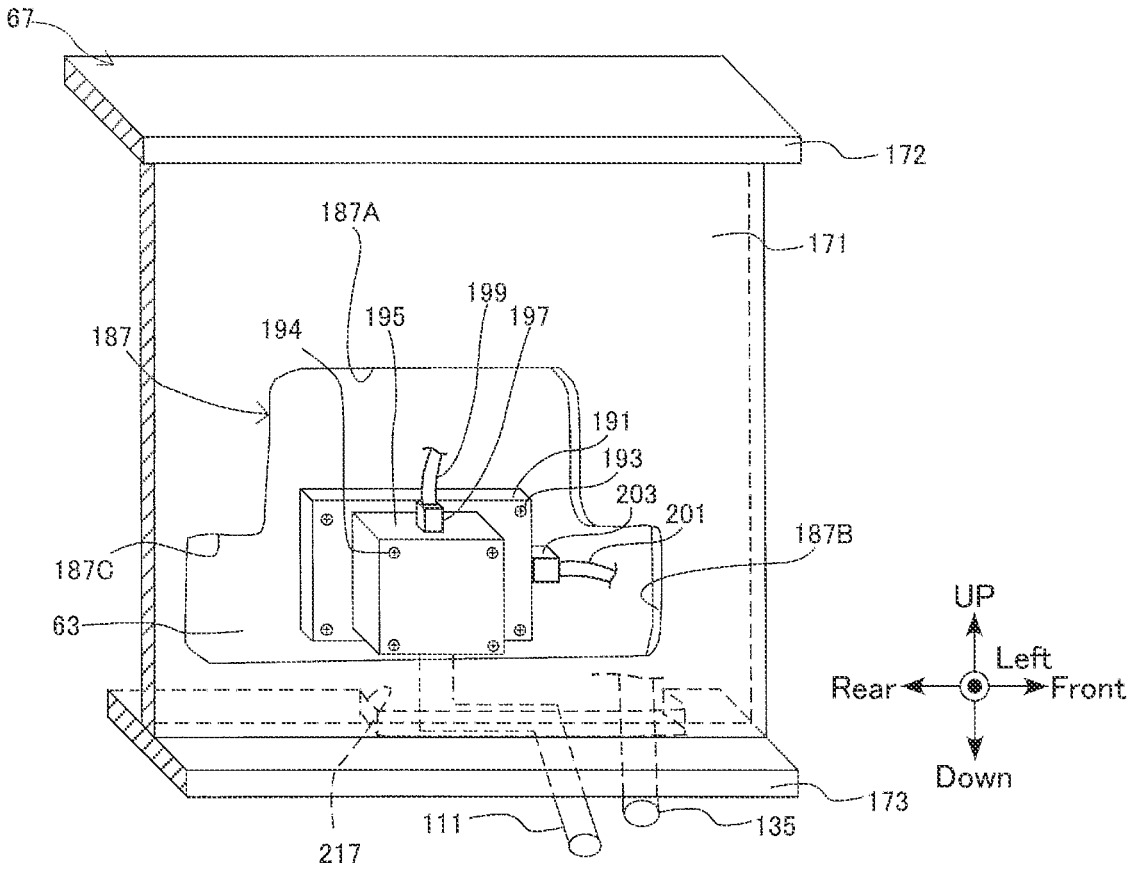
FIG. 8 is an enlarged view of a maintenance opening of the printer in this embodiment.

FIG. 7 shows the cross-section of the chamber 33 taken along the line A-A (the position of the maintenance opening 187) in FIG. 6. FIG. 8 shows an enlarged view of the maintenance opening 187. On the other hand, when the chamber 33 is cut at a position where there are neither the maintenance openings 181 to 187 nor the after-mentioned coupling port valve-actuating air cylinders 195 as illustrated in FIG. 6 (see the line B-B in FIG. 6), the web 171 is illustrated as a configuration which is continuous in the up-down direction (which is formed with no through-hole) as shown in FIG. 2. Further, the second flange 173 is illustrated as a configuration in which the after-mentioned insertion portions 211 to 217 are not formed.

As shown in FIGS. 7 and 8, the coupling port 78 is formed on the lower side of the chamber frame 63 in the up-down direction. In this embodiment, the coupling port 78 is formed in a cylindrical shape penetrating through the chamber frame 63 along the right-left direction (conveyance direction FD) (see FIG. 4). A coupling block 191 is attached to the left side of the coupling port 78. In this embodiment, the coupling block 191 is composed of a box-shaped metal member. The coupling block 191 is internally formed with a passage 191A for allowing the ink 70 to flow therethrough. The passage 191A is formed to provide fluid communication between a left opening of the coupling port 78 and the recovery pipe 111. Thus, the coupling port 78 is connected to the recovery pipe 111 via the coupling block 191. The coupling block 191 is fixed to the chamber frame 63 by screwing members 193 such as bolts. A coupling port valve-actuating air cylinder 195 is fixed to the left side (downstream side) of the coupling block 191. The coupling port valve-actuating air cylinder 195 is fixed to a back (left) surface of the coupling block 191 by screwing members 194 such as bolts. Thus, the coupling block 191 and the coupling port valve-actuating air cylinder 195 are fixed within a given region of the chamber frame 63, respectively, by the screwing members 193 and the screwing members 194.

The coupling port valve 116 is fixed to a distal end of an actuating rod 195A of the coupling port valve-actuating air cylinder 195. Further, an air hose 199 is connected to the coupling port valve-actuating air cylinder 195 through an attaching member 197. In this embodiment, the attaching member 197 is attached to an end of the air hose 199, and formed with an external thread on an outer peripheral surface thereof. The air hose 199 can be connected to the coupling port valve-actuating air cylinder 195 by engaging the external thread of the attaching member 197 with an internal thread provided in an upper portion of the coupling port valve-actuating air cylinder 195. The air hose 199 is connected to the cylinder air supply unit 119 (see FIG. 5) to allow air supply from the cylinder air supply unit 119 to be delivered into the coupling port valve-actuating air cylinder 195. The coupling port valve-actuating air cylinder 195 is configured such that the actuating rod 195A thereof is moved in the right-left direction according to the pressure of air supplied from the cylinder air supply unit 119. Specifically, the coupling port valve-actuating air cylinder 195 is configured to move the coupling port valve 116 to one of a close position (as illustrated in FIG. 7) where it closes the coupling port 78, and an open position where it opens the coupling port 78, according to the movement in the right-left direction of the actuating rod 195A. When the coupling port valve 116 is located at the open position, the coupling port 78 is communicated with the recovery pipe 111. Similarly to the coupling port valve 116, each of the remaining coupling port valves 115, 129, 131, 157, 158 is configured to selectively open and close a corresponding one of the coupling ports 72 to 77, according to actuation of the coupling port valve-actuating air cylinder 195 provided with respect to the corresponding one of the coupling ports 72 to 77.

The cleaning water pipe 201 for supplying the cleaning water WT to the recovery pipe 11 is also connected to the coupling block 191. An attaching member 203 is attached to an end of the cleaning water pipe 201. In this embodiment, the attaching member 203 is formed with an external thread on an outer peripheral surface thereof, and the cleaning water pipe 201 is connected to the coupling block 191 by engaging the external thread of the attaching member 203 with an internal thread provided in a sidewall (in FIG. 8, a front sidewall) of the coupling block 191. In this embodiment, in the state in which the coupling port valve 116 is located at the close position, the cleaning water pipe 201 is communicated with the recovery pipe 111 via the inside of the coupling block 191. The cleaning water pipe 201 delivers the cleaning water WT supplied from the cleaning water supply unit 150 (see FIG. 5), to the recovery pipe 111 via the coupling block 191. This makes it possible to clean the inside of the recovery pipe 111 in the state in which the coupling port 78 is closed.

Here, since a sealing member or the like of the coupling port valve 116 deteriorates due to the operation of repeatedly opening and closing the coupling port 78, the need to replace the coupling port valve-actuating air cylinder 195 arises. Further, since sealing member or the like to be brought into contact with the periphery of the opening of the coupling port 78 deteriorates over time, the need to replace the coupling block 191 also arises. A user needs to periodically replace the coupling port valve-actuating air cylinder 195 and the coupling block 191. For example, when replacing the coupling port valve-actuating air cylinder 195, it is necessary to detach the attaching member 197 and the air hose 199 from the coupling port valve-actuating air cylinder 195 by turning the attaching member 197 with a tool such as a wrench. Further, the user needs to detach the coupling port valve-actuating air cylinder 195 from the coupling block 191 by turning the screwing members 194 with a tool. Then when attaching a new coupling port valve-actuating air cylinder 195 to the coupling block 191, similar work is required. When replacing the coupling block 191 due to deterioration of the coupling block 191, it is also necessary to detach the air hose 199, the water cleaning pipe 201 and the screwing members 193, in a similar manner as that in the replacement of the coupling port valve-actuating air cylinder 195.

The maintenance opening 187 is formed in a shape which makes it easier for the user to perform the above-mentioned replacement work. More specifically, in left side view of the coupling block 191 and the coupling port valve-actuating air cylinder 195, the coupling block 191 extends laterally outwardly with respect to the coupling port valve-actuating air cylinder 195. The maintenance opening 187 is formed in a size extended outwardly beyond a region in which heads of the screwing members 194 or the screwing members 193 are located, e.g., a region (in FIG. 8, a quadrangular region) surrounded by lines each connecting the heads of an adjacent pair of screwing members 193 among the plurality of screwing members 193 which fix the coupling block 191 to the chamber frame 63. This makes it possible to suppress interference between the web 171 and the tool for detaching the screwing members 193 and the screwing members 194, thereby improving user's work efficiency.

Further, the maintenance opening 187 is formed in a stepped convex shape protruding portion upwardly and in the right-left direction, in left side view of the web 171. Specifically, the maintenance opening 187 has an upwardly-protruding upper convex part 187A, a frontwardly-protruding front convex part 187B, and a rearwardly-protruding rear convex part 187C. The maintenance opening 187 is formed in a line-symmetric shape with respect to a straight line passing through a center thereof in the front-rear direction and extending along the up-down direction. Thus, the rear convex part 187C is formed in a shape symmetrical identical to the front convex part 187B rotated by 180 degrees.

The front-rear directional width of the upper convex part 187A is set to be greater than that of the coupling block 191. Further, the upper convex part 187A is formed in a size extending up to a position away from an upper surface of the coupling block 191 upwardly by a given distance. Thus, in an operation of detaching the attaching member 197 attached to an upper surface of the coupling port valve-actuating air cylinder 195, the user can insert his/her hand or a tool into the upper convex part 187A to relatively easily perform the work.

The up-down directional width of the front convex part 187B is set to be approximately equal to that of the coupling block 191. Further, the front convex part 187B is formed in a size extending up to a position away from a front surface of the coupling block 191 frontwardly by a given distance. Thus, in an operation of detaching the attaching member 203 attached to the front surface of the coupling block 191, the user can insert his/her hand or a tool into the front convex part 187B to relatively easily perform the work.

With regard to the coupling port valve-actuating air cylinder 195 attached to each of the coupling ports 72, 73, 74, 76, 77 other than the coupling port 78, the attaching member 197 is attached to an upper surface thereof, as with the coupling port valve-actuating air cylinder 195 illustrated in FIG. 8. Further, the maintenance openings 181, 182, 183, 185, 186 each having the same shape as that of the maintenance opening 187 are formed in the web 171, in accordance with respective positions of the coupling port valve-actuating air cylinders 195 for the coupling ports 72, 73, 74, 76, 77. Thus also makes it possible to facilitate attaching/detaching of the attaching members 197, 203 for the other coupling ports 72, 73, 74, 76, 77.

In the coupling block 191 for each of the coupling ports 76, 77 provided on the front side with respect to the front-rear directional center of the chamber frame 63, the attaching member 203 is attached to a front surface thereof, as with the coupling block 191 illustrated in FIG. 8 for the coupling port 78. On the other hand, in the coupling block 191 for each of the coupling ports 72, 73, 74 provided on the rear side with respect to the front-rear directional center of the chamber frame 63, the attaching member 203 and the cleaning water pipe 201 are attached to a rear side surface thereof, in such a manner as to be symmetrical to the coupling block 191 illustrated in FIG. 8 for the coupling port 78, in the front-rear direction. As mentioned abode, the rear convex part 187C is formed in a shape symmetrical to the front convex part 187B. Thus, by forming the maintenance openings 181 to 183 and 185 to 187 in the same shape with the front convex part 187B and the rear convex part 187C, it is possible to improve efficiency of the work of attaching and detaching the attaching member 203, irrespective of whether the attaching member 203 is attached to the front surface or the rear surface of the coupling block 191. Further, by forming the maintenance openings 181 to 183 and 185 to 187 in the same shape, it is possible to improve efficiency of work of processing the maintenance openings 181 to 183 and 185 to 187 to the steel member 67. Furthermore, it is possible to reduce production cost of the steel member 67 with the maintenance openings 181 to 183 and 185 to 187. In this embodiment, the maintenance opening 184 for the front-rear directional central coupling port 75 is also formed in the same shape as that of the maintenance opening 187. This facilitates attaching/detaching of a line connected to the three-way switching solenoid valve 96, e.g., in work of replacing the three-way switching solenoid valve 96. Further, by forming the maintenance opening 184 to have the same shape as that of the maintenance opening 187, it is possible to reduce production cost of the steel member 67.

As shown in FIG. 6, the second flange 173 is formed with a plurality of (in this embodiment, seven) insertion parts 211, 212, 213, 214, 215, 216, 217. The recovery pipe 121, the drain pipe 153, the recovery pipe 122, the ink supply pipe 93, the recovery pipe 109, the drain pipe 153 and the recovery pipe 111 are inserted, in this order, into the insertion parts 211 to 217, respectively (see FIG. 3). Further, the surplus ink recovery pipe 135 is inserted in the front-rear directional frontmost insertion part 217, in addition to the recovery pipe 111. Similarly, the surplus ink recovery pipe 133 is inserted in the front-rear directional rearmost insertion part 211, in addition to the recovery pipe 121. With regard to the remaining insertion parts 212 to 216, only one pipe (recovery pipe, such as recovery pipe 122) is inserted in each of them. The insertion parts 211 to 217 are formed in the same configuration, except for the number of pipes inserted in each insertion part (the surplus ink recovery pipe 133 or 135 is additionally inserted in a part of them) and the size (e.g., inner hole diameter) of the insertion part. Thus, in the following description, the frontmost insertion part 217 will be mainly described, and description of the remaining insertion parts 211 to 216 will be appropriately omitted.

Figure 9:
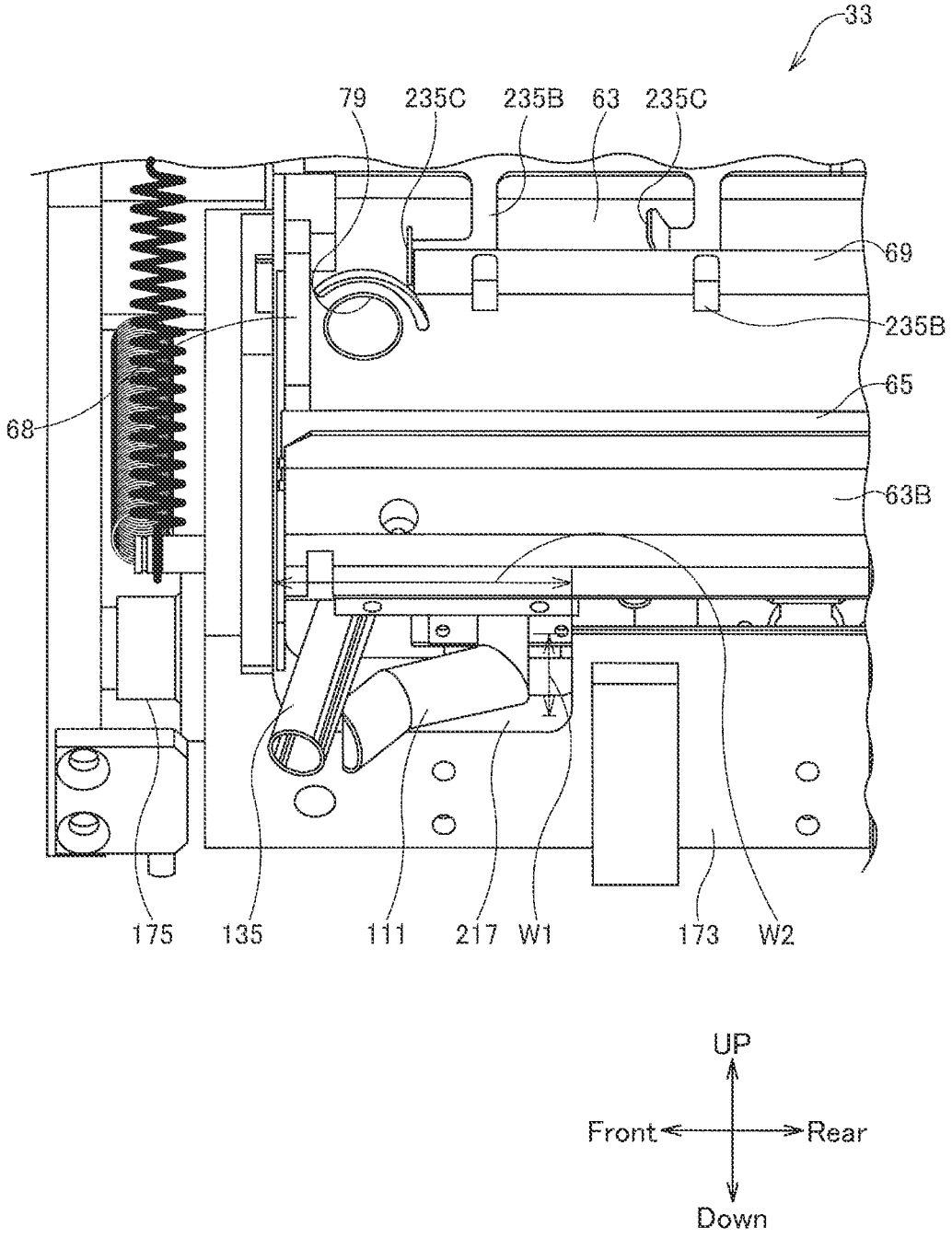
FIG. 9 is perspective view of the chamber of the printer in this embodiment, when viewed obliquely upwardly from the lower side on the right side thereof.

FIG. 9 is a perspective view of the chamber 33 when viewed obliquely upwardly from the lower side on the right side thereof. As shown in FIGS. 8 and 8, the second flange 173 is formed with the insertion part 217. The surplus ink recovery pipe 135 is inserted in the insertion part 217, in addition to the recovery pipe 111, as mentioned above. In this embodiment, the insertion part 217 is composed of a cutout formed by concavely cutting the second flange 173 from a right (upstream) end toward a left (downstream) end thereof, wherein the cutout has an opening on the right side (on the side of the chamber frame 63). The insertion part 217 is formed to have an approximately constant width W1 in the right-left direction, and a width W2 along the front-rear direction.

In this embodiment, the right-left directional width W1 of the insertion part 217 is set to be slightly greater than the outer diameter of the recovery pipe 111 or the surplus ink recovery pipe 135. In this embodiment, as shown in FIG. 7, the insertion part 217 is formed in a region on the right side (on the side of the chamber frame 63) with respect to the intermediate portion 173A of the second flange 173 to which the lower end of the web 171 is connected. In other words, the web 171 is not partly removed by forming the insertion part 217. Further, a front end of the insertion part 217 is coincident with the position of the dam plate 68 in the front-rear direction (the position of a front end of the doctor blade 65).

The front-rear directional rearmost insertion part 211 is formed in the same shape as that of the insertion part 217, and the surplus ink recovery pipe 133 and the recovery pipe 121 are inserted therein. Each of the insertion parts 212 to 216 other than the insertion parts 211, 217 at the front-rear directional opposite ends of the steel member 67 is formed in a size less than that of the insertion parts 211, 217 in terms of the front-rear directional width W2, e.g., because it is not designed to allow two carrier pipes to be inserted thereinto. On the other hand, the right-left directional width W1 of each of the insertion parts 212 to 216 is set to be equal to that of the insertion parts 211, 217. It should be noted that the shape of the insertion part 217 illustrated in FIGS. 7 to 9 is one example. The insertion part 217 may be a through-hole penetrating through the second flange 173 (a hole whose outer periphery is surrounded by the second flange 173). Further, the insertion part 217 may be formed such that a part thereof extends up to the lower end of the web 171. Further, the insertion parts 211 to 217 may have different shapes.

Figure 10:
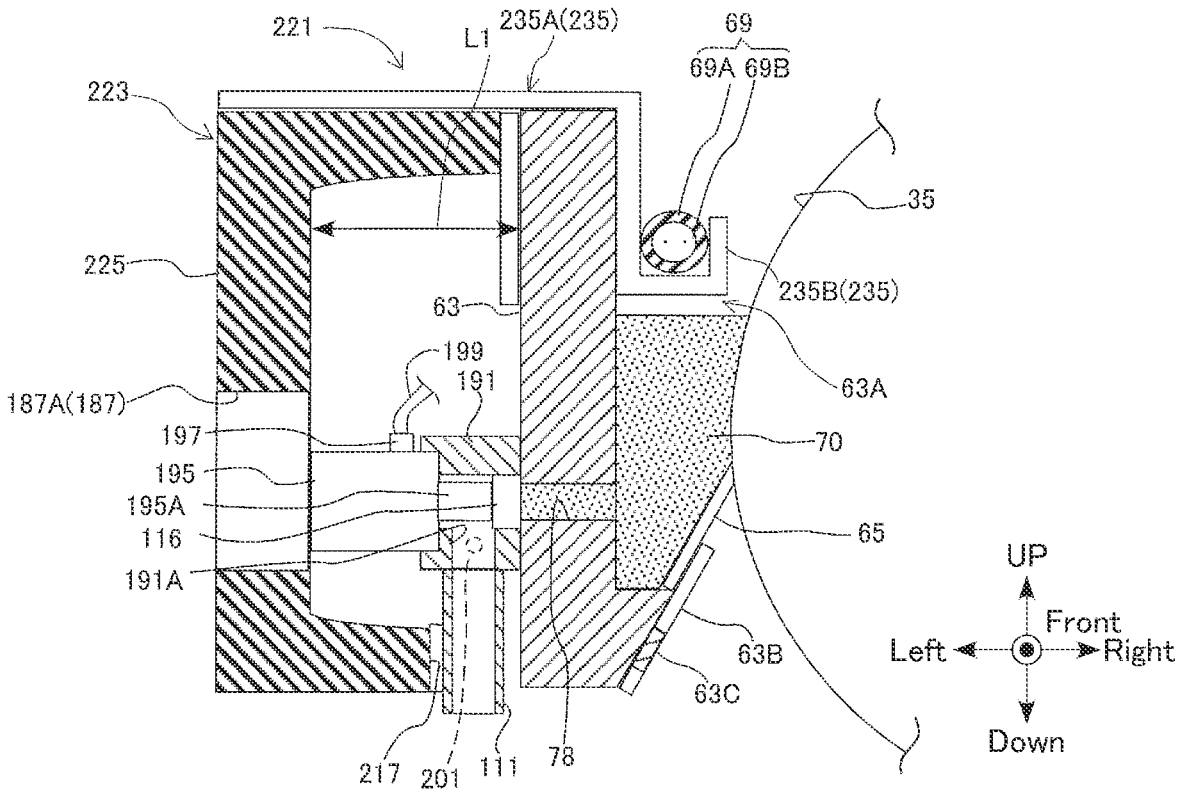
FIG. 10 is a sectional view of a chamber of a first comparative example.
Figure 11:
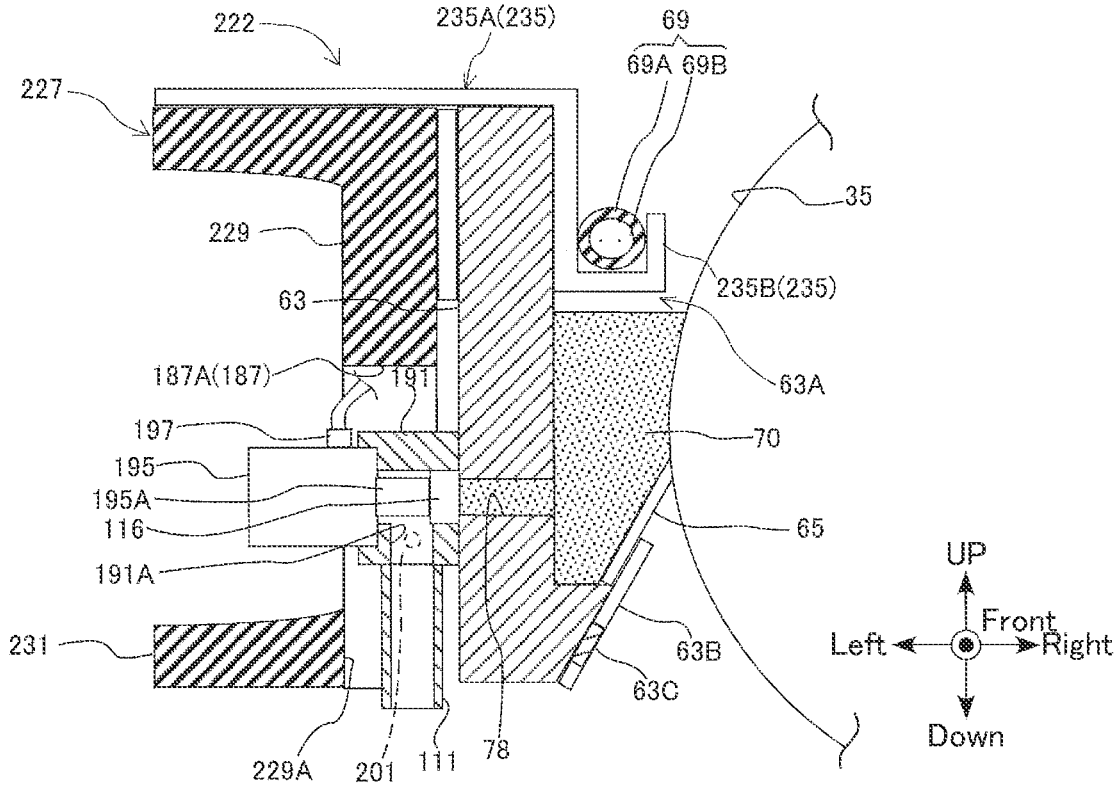
FIG. 11 is a sectional view of a chamber of a second comparative example.

According to the above-mentioned configuration, the chamber 33 in this embodiment makes it possible to increase rigidity of the chamber 33 while improving efficiency of maintenance such as the work of replacing the coupling port valve-actuating air cylinder 195. This will be described in more detail. FIG. 10 illustrates a chamber 221 as a first comparative example. FIG. 11 illustrates a chamber 222 as a second comparative example. In description about FIGS. 10 and 11, any element or component similar to that of the chamber 33 illustrated in FIG. 7 will be assigned with the same reference sign, and description thereof will be appropriately omitted.

The chamber 221 illustrated in FIG. 10 comprises a steel member 223 of C-section steel. When the steel member 223 of C-section steel is disposed such that a web 225 of the steel member 223 is located on the left side thereof, and an opening of the steel member 223 is located on the right side thereof, a right-left directional length L1 between the chamber frame 63 and the web 225 becomes longer. For example, the coupling port valve-actuating air cylinder 195 is entirely received in a space surrounded by the steel member 223 and the chamber frame 63. In this configuration, each of the attaching members 197, 203, etc., is located at a position farther from a maintenance opening 187 (position deeper from the opening of the maintenance opening 187). Thus, the user's hand or a tool inserted from the maintenance opening 187 becomes less likely to reach the attaching members 197, 203, resulting in deteriorated work efficiency. On the other hand, if the maintenance opening 187 is enlarged to improve the work efficiency, rigidity of the steel member 223 is lowered.

By contrast, in this embodiment, an I-section steel is used as the steel member 67, as shown in FIG. 7, so that it is possible to reduce a right-left directional distance L2 between the web 171 and the chamber frame 63. For example, the coupling port valve-actuating air cylinder 195 is partly or entirely received with the maintenance opening 187. Thus, the user's hand or a tool inserted from the maintenance opening 187 becomes more likely to reach the attaching members 197, 203, resulting in improved work efficiency.

The chamber 222 illustrated in FIG. 11 comprises a steel member 227 of C-section steel which is similar to the steel member 227 after being rotated by 180 degrees. A web 229 of the steel member 227 is located at a position close to the chamber frame 63 in the right-left direction. In this case, the maintenance opening 187 is also located at a position close to the chamber frame 63, and therefore it is possible to facilitate maintenance such as the work of replacing the coupling port valve-actuating air cylinder 195. On the other hand, in order to ensure an insertion space for the recovery pipe 111 or the surplus ink recovery pipe 135 (see FIG. 3), it is necessary to form an insertion part (cutout or hole) by largely removing a part of the web 229. More specifically, it is necessary to form a cutout 222A in a lower half of the web 229 and a part of a second flange 231, in accordance with a layout position of, e.g., the recovery pipe 111, as shown in FIG. 11. As a result, the need to remove a part of the web 229 and the second flange 231, and a connection portion between the web 229 and the second flange 231 arises, leading to significant lowering in rigidity of the steel member 227.

By contrast, in the chamber 33 in this embodiment, by disposing the web 171 at a position spaced apart from the chamber frame 63 by a given distance in the right-left direction, it is possible to reduce the size of the maintenance opening 187 formed in the web 171, as shown in FIG. 7. Further, it is possible to eliminate the need to form the insertion part 217 in a connection portion (intermediate portion 173A) between the web 171 and the second flange 173. As a result, it is possible to maintain a desired rigidity of the steel member 67, even if the maintenance openings 181 to 187 and the insertion parts 211 to 217 are formed in the steel member 67.

(Rod Member)

Next, the rod member 69 will be described. As shown in FIG. 4, the chamber 33 is provided with a plurality of rod members 69. The rod members 69 are formed in the same shape, i.e., a circular cylindrical shape along the front-rear direction. The rod members 69 are arranged side by side in a line along a straight line parallel to the front-rear direction. Any front-rear directional neighboring two of the rod members 69 are arranged at positions close to each other in the front-rear direction. Alternatively, the rod members 69 may be composed of a single rod member extending along the front-rear direction.

As shown in FIG. 7, each of the rod members 69 is formed by subjecting a metal core 69B to surface coating using a resin material 69A. The rod member 69 is surface-coated with the resin material 69A over the entire circumference of an outer peripheral surface thereof. In this embodiment, the resin material 69A on the surface has liquid-repellency which is a property of repelling the ink 70. Thus, when the cleaning water WT is splayed from the nozzles 151 to the rod members 69 during the cleaning operation by the cleaning unit 149, it is possible to enhance easiness in removal of the ink 70 on the rod members by spraying of the cleaning water WT. It should be noted that the above-mentioned configuration of the rod member 69 is one example. The rod member 69 may be configured such that the outer peripheral surface thereof is partly surface-coated with the resin material 69A having repellency. Further, the rod member 69 may be configured such that only a portion thereof onto which the ink 70 is highly likely to adhere, such as a right surface or a lower surface, is surface-coated with the resin material 69A. Alternatively, the entire rod member 69 including the core may be formed of the resin material 69A, or the entire rod member 69 may be composed of only the metal core 69B (without the resin material 69A).

As shown in FIGS. 4 and 7, the chamber 33 comprises a plurality of holding members 235 each holding a respective one of the rod members 69. Each of the plurality of holding members 235 is formed by subjecting a thin metal plate to bending. In this embodiment, each of the plurality of holding members 235 has a similar configuration which comprises a base 235A, and two or more hooks 235B. The base 235A is bent to extend along an upper surface of the first flange 172, an upper surface of the chamber frame 63 and a right surface of the chamber frame 63. The plurality of holding members 235 are fixed to the first flange 172 by a plurality of screwing members 237. In this embodiment, each of the plurality of screwing members 237 is composed of a screw with a handgrip, wherein the screw is threadingly engageable with an internally threaded portion of the first flange 172 through a through-hole of the base 235A. The base 235A is fixed to the first flange 172 by threadingly engaging two of the plurality of screwing members 237 provided at front-rear directional opposite ends thereof with the first flange 172.

Each of the hooks 235B is formed to protrude downwardly from a lower end of the portion of the base 235A extending along the right surface of the chamber frame 63. In this embodiment, the number of the hooks 235 formed in each of the plurality of holding members 235 is eight. Each of the hooks 235B is formed in an elongate plate shape extending downwardly along the up-down direction from the lower end of the base 235A. A lower end of each of the hooks 235B is bent rightwardly (toward the upstream side) and then further bent upwardly. When viewed in the front-rear direction, a distal end portion of the hook 235B is bent into an approximately C shape opened upwardly. Each of the rod members 69 is disposed while being pinched by the bent distal end portion of the hook 235B.

Further, among the two or more hooks 235B, a given hook 235B is formed with a locking piece 235C. In this embodiment, in the frontmost holding member 235 illustrated in FIG. 4, the frontmost hook 235B, the second-frontmost hook 235B and second-rearmost hook 235B are formed, respectively, with three locking pieces 235C. The locking piece 235C formed in the frontmost hook 235B is formed in a shape which protrudes frontwardly from a portion of the frontmost hook 235B facing a back surface (left surface) of the rod member 69, and is then bent rightwardly, wherein a distal end portion of the locking piece 235C is in contact with a front end face of the rod member 69. The front end face of the rod member 69 is held by the locking piece 235C. Similarly, a rear end face of the rearmost rod member 69 is held by a locking piece 235C formed in the rearmost hook 23B in the rearmost holding member 235, although illustration is omitted.

The locking piece 235C formed in the second-frontmost hook 235B is formed in a shape which protrudes frontwardly from a portion of the second-frontmost hook 235B located above the rod member 69, and is then bent rightwardly.

Symmetrically to this, the locking piece 235C formed in the second-rearmost hook 235B is formed in a shape which protrudes rearwardly from a portion of the second-rearmost hook 235B located above the rod member 69, and is then bent rightwardly. Each of the two locking pieces 235C is formed at a position which is in contact with an upper surface of the rod member 69 attached to the distal end portions of the hooks 235B.

In this embodiment, in any holding member 235 other than the holding members 235 at the front-rear directional opposite ends, only two locking pieces 235C are formed, respectively, in the second-frontmost hook 235B and second-rearmost hook 235B, without forming the locking piece 235C in the frontmost hook 235B. As above, a lower portion of each of the rod members 69 is held by the distal end portions of the hooks 235B, and an upper portion of each of the rod members 69 is locked by the two locking pieces 235C of the holding member 235, so that each of the rod members 69 is clamped from both sides in the up-down direction by the hooks 235B and the two locking pieces 235C, whereby rotation of the rod members 69 is restricted. Alternatively, the holding members may be configured to allow the rod members 69 to freely rotate.

The rod members 69 are held, respectively, by the plurality of holding members 235, so that they are held at a given height position in the up-down direction and at respective positions on the right side of the chamber frame 63 in the right-left direction. Each of the rod members 69 is held at an upper position in a region on the right side of the chamber frame 63. In other words, each of the holding members 235 holds a corresponding one of the rod members 69 at an up-down directional upper position within a region where the chamber frame 63 is located. The rod members are arranged with a given gap with respect to the outer peripheral surface of the anilox roll 35. That is, each of the rod members 69 is disposed in spaced-apart relation to the anilox roll 35.

Figure 12:
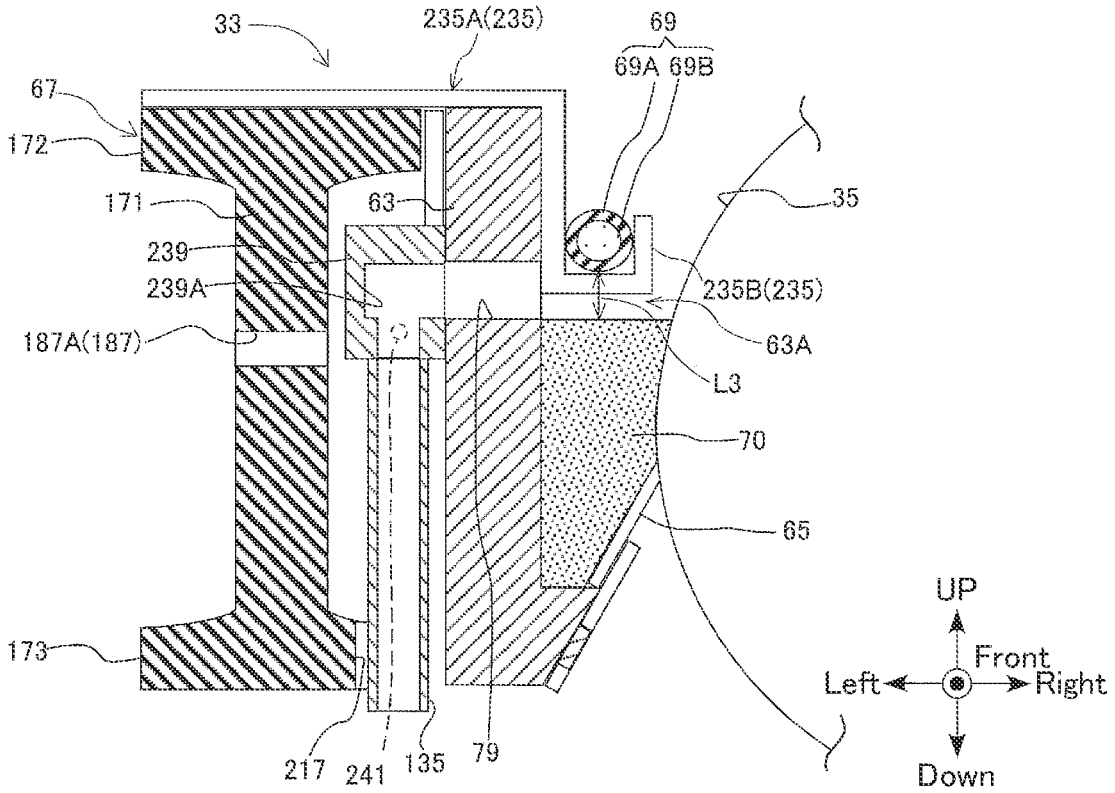
FIG. 12 is a sectional view of the chamber, taken along the line C-C in FIG. 6.

FIG. 12 illustrates a cross-section of the chamber, taken along the line C-C in FIG. 6, passing through a position where the coupling port is located. As shown in FIG. 12, the rod member 69 is disposed at a position located just above and spaced apart from the liquid level of the ink 70 reserved in the ink reservoir 63A. More specifically, the coupling port 79 is formed in the chamber frame 63 at a position having a given height in the up-down direction. In this embodiment, the coupling port 79 is formed in a cylindrical shape penetrating through the chamber frame 63 along the right-left direction (see FIG. 9). A coupling block 239 is attached on the left side of the coupling port 79. The coupling block 239 is fixed to a left surface (back surface) of the chamber frame 63, e.g., by a screwing member (illustration is omitted) such as a bolt.

In this embodiment, the coupling block 239 is composed of a box-shaped metal member. The surplus ink recovery pipe 135 is connected to a lower end of the coupling block 239. The coupling block 239 is internally formed with a passage 239A for allowing the ink 70 to flow therethrough. The passage 239A is formed to provide fluid communication between a left opening of the coupling port 79 and the surplus ink recovery pipe 135. When the ink 70 supplied to the ink reservoir 63A is reserved to reach the height position of the coupling port 79, further supplied ink flows out from the coupling port 79 to the surplus ink recovery pipe 135 through the coupling block 238, and will be recovered to the ink can 91 (see FIG. 3) via the surplus ink recovery pipe 135. In this way, the height of the liquid level of the ink 70 reserved in the ink reservoir 63A is maintained at a given height. A cleaning water pipe 241 is connected to a front side surface of the coupling block 239. The cleaning water pipe 241 delivers the cleaning water WT supplied from the cleaning water supply unit 150, to the surplus ink recovery pipe 135 via the passage 239A, thereby cleaning the surplus ink recovery pipe 135.

When the rod member 69 is held by the holding member 235, it is disposed at a position located at a position above the lower end of the coupling port 79 in the up-down direction by a given distance L3. Similarly, on the rear side of the chamber 33, when the rod member 69 is held by the holding member 235, it is disposed at a position above the lower end of the coupling port 71 in the up-down direction by a given distance L3. Here, when the anilox roll 35 is rotated in a state in which the ink 70 is reserved in the ink reservoir 63A, the anilox roll 35 is rotated such that air is entrained into the ink 70, and thereby the ink 70 bubbles up. In particular, when the anilox roll 35 is rotated at a high speed to increase printing efficiency, bubbling ink 70 will splash all around. In contrast, by disposing the rod member 69 at a position located upwardly from the liquid level of the ink 70 by the given distance L3, generated bubbles hit the bar member 69 and break, thereby suppressing bubbling. The applicant of this application carried out experiments while changing the shape of the rod members 69. As a result, the applicant has found that a high bubbling suppression effect can be obtained by setting the shape of the rod members 69 particularly to a circular cylindrical shape. The distance L3 is set to a value at which the bubbling suppression effect becomes higher. In other words, the holding members hold the rod members 69 at a position providing a higher bubbling suppression effect. In this embodiment, the holding members holds the rod members 69 such that a lower end of each of the rod members 69 is located at approximately the same height as that of an upper end of the coupling port 79, as shown in FIGS. 4 and 12.

(Pressing Device)

Next, a pressing device 243 comprised in the printer 13 will be described. As shown in FIG. 6, the printer 13 in this embodiment comprises a pressing device 243 as a means to apply a pressing force to press the chamber 33 toward the anilox roll 35 (rightwardly). The pressing device 243 comprises a low-pressure air supply unit 245, a high-pressure air supply unit 246, and a plurality of (in this embodiment, ten) air cylinders 251 to 260. The air cylinders 251, 252, 253, 254, 355, 256, 257, 258, 259, 260 are attached to the web 171 of the steel member 67, while being aligned in this order in the rear-to-front direction. The air cylinders 251 to 259 are arranged side by side along the front-rear direction with a given distance between adjacent ones thereof. The air cylinder 251 is mounted between the coupling port 71 and the coupling port 72 in the front-rear direction (see FIG. 3). Similarly, the air cylinder 252 is mounted between the coupling port 72 and the coupling port 73. The air cylinder 253 is mounted between the coupling port 73 and the coupling port 74. The air cylinders 254, 255 are mounted between the coupling port 74 and the coupling port 75. The air cylinders 256, 257 are mounted between the coupling port 75 and the coupling port 76. The air cylinder 258 is mounted between the coupling port 76 and the coupling port 77. The air cylinder 259 is mounted between the coupling port 77 and the coupling port 78. The air cylinder 260 is mounted between the coupling port 78 and the coupling port 79.

Among the ten air cylinders 251 to 260 aligned in the front-rear direction, four central air cylinders 254 to 257 are connected to the high-pressure air supply unit 246 via a high-pressure air supply pipe 264. Further, the air cylinders 251 to 253 arranged on the rear side with respect to the four central air cylinders 254 to 257, and the air cylinders 258 to 260 arranged on the front side with respect to the four central air cylinders 254 to 257 are connected to the low-pressure air supply unit 245 via a low-pressure air supply pipe 263. In this embodiment, the low-pressure air supply unit 245 comprises: an air compressor for generating compressed air; a pressure reducing valve for reducing the pressure of the compressed air to a value usable for driving the air cylinders 251 to 253, 358 to 260; and a solenoid valve for switching supply of the pressure-reduced air to each of the air cylinders 251 to 253, 358 to 260. Similarly, the high-pressure air supply unit 246 comprises an air compressor, and is configured to supply desired compressed air to the air cylinder 254 to 257.

The low-pressure air supply unit 245 supplies compressed air having a given pressure to each of the air cylinders 251 to 253, 358 to 260. On the other hand, the high-pressure air supply unit 246 supplies compressed air having a pressure higher than that of the low-pressure air supply unit 245 to each of the air cylinders 254 to 257. In this embodiment, the air cylinders 251 to 260 have the same structure which is configured to press the chamber frame 63 by a pressing force according to the pressure of compressed air supplied from the low-pressure air supply unit 245 or the high-pressure air supply unit 246, as described in detail later. Thus, each of the four air cylinders 254 to 257 arranged in the central region in the front-rear direction is capable of applying, to the chamber frame 63, a pressing force greater than a pressing force of each of the air cylinders 251 to 253 and the air cylinders 358 to 260 arranged, respectively, on both sides of the four air cylinders 254 to 257 in the front-rear direction (the pressing force of each of the air cylinders 251 to 253, 358 to 260 will hereinafter be referred to as "first pressing force", and the pressing force of each of the four air cylinders 254 to 257 will hereinafter be referred to as "second pressing force"). It should be understood that the air cylinders 251 to 260 are not limited to having the same structure but may have different structures.

Figure 13:
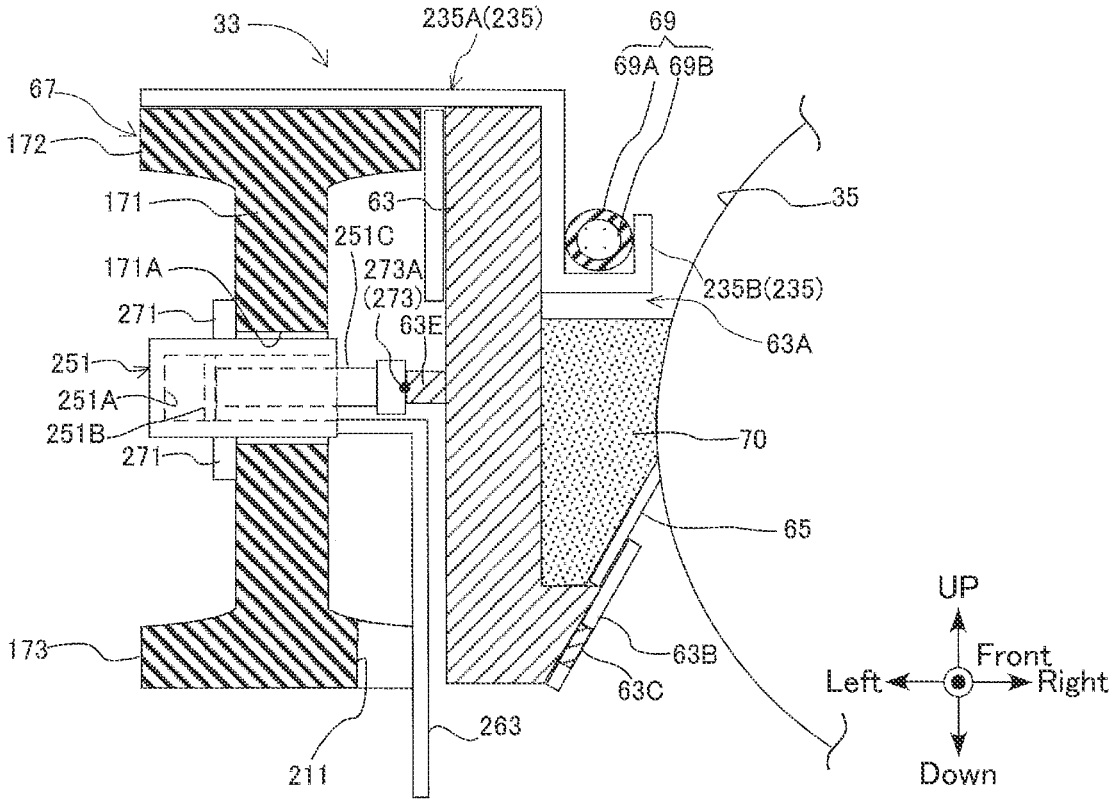
FIG. 13 is a sectional view of the chamber, taken along the line D-D in FIG. 6.

The air cylinders 251 to 260 have the same configuration, except that the pressure of compressed air to be supplied thereto is different between the two groups. Thus, in the following description, the air cylinder 251 will be mainly described, and description of the remaining air cylinders 252 to 260 will be appropriately omitted. FIG. 13 is a sectional view of the chamber 33 taken along the line D-D in FIG. 6, i.e., taken along a line extending in the up-down direction and passing through the air cylinder 251. As shown in FIG. 13, the air cylinder 251 comprises a cylinder tube 251A, a piston 251B received in the cylinder tube 251A, and a rod 251C configured to be moved together with the piston 251B according to a pressure applied to the piston 251B.

The web 171 is formed with a mounting hole 171A at a position for mounting the air cylinder 251. The mounting hole 171A is formed to penetrate through the web 171 along the right-left direction, and have an inner diameter according to the size of the cylinder tube 251A. In this embodiment, the air cylinder 251 is mounded by inserting a part of the cylinder tube 251A into the mounting hole 171A and then fixing the cylinder tube 251A to the web 171 by a screwing member 271.

A protrusion 63E is formed on the left surface of the chamber frame 63 in accordance with the position of the air cylinder 251. The protrusion 63E is formed to protrude leftwardly, i.e., towards the web 171. In this embodiment, the protrusion 63E is formed in a columnar shape extending orthogonally from the left surface of the chamber frame 63, and fixed to the chamber frame 63. The rod 251C protrudes rightwardly from the cylinder tube 251A, and a distal end thereof is in contact with the protrusion 63E. In other words, the up-down directional, right-left directional and front-rear directional positions of the air cylinder 251 are adjusted such that the rod 251C is set at a position where it can press the protrusion 63E. In this embodiment, the rod 251C is disposed to press the protrusion 63E along the right-left direction along which the protrusion 63E extends, i.e., along a direction orthogonal to the left surface of the chamber frame 63. This makes it possible to efficiently transfer the pressing force from the air cylinder 251 to the chamber frame 63.

In this embodiment, a pressing area 273 where the air cylinder 251 presses the chamber frame 63 corresponds to a location where the rod 251C comes into contact with the protrusion 63E. The air cylinder 251 is disposed in a location which is the middle of the steel member 67 and the chamber frame 63 in the up-down direction. The pressing area 273 is located in the location which is the middle of the steel member 67 and the chamber frame 63 in the up-down direction. In other words, the rod 251 and the protrusion 63E are arranged in the location which is the middle of the steel member 67 and the chamber frame 63 in the up-down direction. Similarly, the pressing area 273 of each of the remaining air cylinders 252 to 260 is also located in the location which is the middle of the steel member 67 and the chamber frame 63 in the up-down direction. Thus, the pressing area 273 of each of the air cylinders 251 to 253, 358 to 260 for applying the first pressing force (one example of "first pressing area" set forth in the appended claims) and the pressing area 273 of each of the air cylinders 254 to 257 for applying the second pressing force (one example of "second pressing area" set forth in the appended claims) are also located in the location which is the middle of the steel member 67 and the chamber frame 63 in the up-down direction. In the following description, for the sake of explanation, the pressing area 273 of each of the air cylinders 251 to 253, 358 to 260 will be referred to as "first pressing area 273A", and the pressing area 273 of each of the air cylinders 254 to 257 will be referred to as "second pressing area 273B". Further, a generic term including the first pressing area 273A and the second pressing area 273B will be described as "pressing area 273". Further, the first pressing force means a force with which each of the air cylinders 251 to 253, 358 to 260 presses the first pressing area 273A. The second pressing force means a force with which each of the air cylinders 254 to 257 presses the second pressing area 273B.

Figure 14:
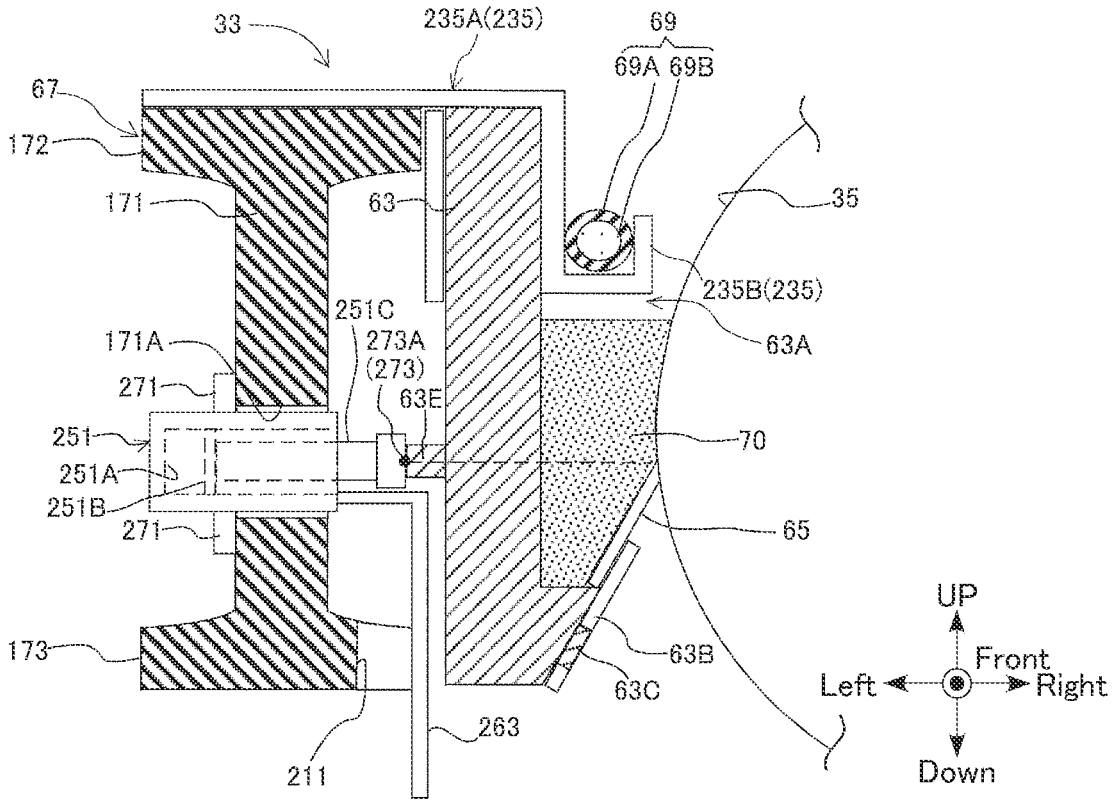
FIG. 14 is a sectional view of a chamber in a modification of this embodiment.

It should be understood that the positions, etc., of the air cylinder 215, the rod 251C, the first pressing area 273A and the protrusion 63E illustrated in FIG. 13 are one example. For example, as shown in FIG. 14, the printer 13 may be configured such that the pressing areas 273 of the air cylinders 251 to 260 are arranged in a location opposed to the doctor blade 65, e.g., the distal end (upper end) of the doctor blade 65, across the chamber frame 63 in the right-left direction. Alternatively, the printer 13 may be configured such that the pressing areas 273 of the air cylinders 251 to 260 are arranged in a location opposed to the lower end of the doctor blade 65 (the mounting member 63B) across the chamber frame 63 in the right-left direction.

The low-pressure air supply pipe 263 is connected to the cylinder tube 251A of the air cylinder 251. The low-pressure air supply pipe 263 delivers the low-pressure compressed air supplied from the low-pressure air supply unit 245, to the cylinder tube 251A. According to pressure in the cylinder tube 251A, the rod 251C is moved to press the protrusion 63E (first pressing area 273A) rightwardly. Similarly, each of the remaining low-pressure air cylinders 252 to 253, 358 to 260 presses a corresponding one of the first pressing areas 273A, under pressure control of the low-pressure air supply unit 245. Further, each of the high-pressure air cylinders 254 to 257 presses a corresponding one of the second pressing areas 273B, under pressure control of the high-pressure air supply unit 246.

In this embodiment, the low-pressure air supply pipe 263 connected to the air cylinder 251 is connected to the low-pressure air supply unit 245 through the insertion portion 211, as shown in FIG. 13. Each of the low-pressure air supply pipes 263 and the high-pressure air supply pipes 264 connected to the remaining air cylinders 252 to 260 is also connected to a corresponding one of the low-pressure air supply unit 245 and the high-pressure air supply unit 246, through a corresponding one of the insertion portions 212 to 217. Alternatively, dedicated holes for allowing the low-pressure air supply pipes 263 and the high-pressure air supply pipes 264 to pass therethrough may be formed in the second flange 173. Alternatively, the low-pressure air supply pipe 263 or the high-pressure air supply pipe 264 may be connected to a corresponding one of the air cylinders 251 to 260 at a position on the left side of (outside) the web 171. In this case, it is possible to eliminate the need to form the holes for allowing the low-pressure and high-pressure air supply pipes 263, 264 to pass therethrough, in the second flange 173.

Each of the above-mentioned air cylinders 251 to 260 is one example of "fluid cylinder" set forth in the appended claims. The fluid cylinder to be used in the present invention is not limited to an air cylinder, but may be any other suitable fluid cylinder such as an oil hydraulic cylinder. Further, in the pressing device 243 for pressing the chamber frame 63, an actuator is not limited to a fluid cylinder, but may be any non-fluid actuator such as an electric cylinder.

Meanwhile, in a flexo printer such as the printer 13, when performing printing by pressing the printing plate 37 of the printing roll 31 against the corrugated paperboard sheet SH being conveyed at a given speed, the printing roll 31 is subjected to a load from the corrugated paperboard sheet SH. Thus, when the anilox roll 35, the chamber frame 63 or the like is subjected to the load, it vibrates in a bending mode. In the printer 13 in this embodiment, bending or vibration in front-rear directional (printer width-directional) central region of the anilox roll 35 or the chamber frame 63 becomes greater than that in opposite end regions which are two outer regions on both sides of the central region in the front-rear direction. As a measure against this, the pressing device 243 is configured such that the second pressing force of the front-rear directional center air cylinders 254 to 357 becomes greater than the first pressing force of the front-rear directional outer air cylinders 251 to 253, 358 to 260. In other words, in a state in which no pressing force is applied by the pressing device 243, bending occurring in the chamber frame 63 due to a load transmitted from the printing roll 31 to the chamber frame 63 via the anilox roll 35 as printing is performed to the corrugated paperboard sheet SH is greater in the second pressing area 273B for the air cylinders 254 to 257 than in the first pressing area 273A for the air cylinders 251 to 253, 358 to 260. This makes it possible to press a region where bending or vibration is likely to become larger, by a larger pressing force, thereby effectively suppressing bending or vibration of the chamber frame 63.

In this embodiment, the pressure of compressed air to be supplied by the high-pressure air supply unit 246 is set to a value which is 20% greater than the pressure of compressed air to be supplied by the low-pressure air supply unit 245. Further, the pressing device 243 in this embodiment is configured to changeably set the pressure of compressed air to be supplied by each of the low-pressure air supply unit 245 and the high-pressure air supply unit 246, i.e., the first pressing force and the second pressing force. In this embodiment, the low-pressure air supply unit 245 and the high-pressure air supply unit 246 are equipped, respectively, with a pressure reducing valve 245A and a pressure reducing valve 246A each provided on the front side of the front printer frame 61A, as shown in FIG. 3. The user can manipulate a handle of the pressure reducing valve 245A to adjust the pressure of compressed air to be supplied from the low-pressure air supply unit 245, i.e., the first pressing force. Similarly, the user can manipulate a handle of the pressure reducing valve 246A to adjust the pressure of compressed air to be supplied from the high-pressure air supply unit 246 (to adjust the second pressing force).

Further, as shown in FIG. 5, the control device 81 is configured to control the low-pressure air supply unit 245 and the high-pressure air supply unit 246 through the drive circuit group 84. In this embodiment, the control device 81 is operable to adjust the pressure of compressed air to be supplied from each of the low-pressure air supply unit 245 and the high-pressure air supply unit 246 by accepting an input of a desired pressure value for each of the low-pressure air supply unit 245 and the high-pressure air supply unit 246 through the manipulation unit 83 of the printer 13, and controlling each of the pressure reducing valves 245A, 246A based on the input pressure value.

However, the way to accept an instruction for changing the pressing force is not limited to the above technique of accepting an input of a pressure value. For example, the control device 81 may be configured to display a plurality of pressure values on the manipulation unit 83, and accept a selected one of the displayed pressure values. Further, the control device 81 may be configured to accept, by the manipulation unit 83, at least one of: a value of the pressing force to press the protrusion 63E by each of the air cylinders 251 to 260; a value of the thickness of a corrugated paperboard sheet SH to be printed; a value of the width of the corrugated paperboard sheet SH along the front-rear direction; a value of the basis weight of the corrugated paperboard sheet SH; and a flute type of the corrugated paperboard sheet SH. The flute type here may be information indicating the flute type itself such as A flute or B flute, or may be information indicating the structure of flute such as the numbers of ridges of a fluted portion. A load applied from the corrugated paperboard sheet SH to the chamber frame 63 varies depending on the thickness, width, basis weight and flute type. Thus, the control device 81 may be configured to change the pressure value according to the thickness, etc., of the corrugated paperboard sheet SH to adjust the pressing force. Specifically, in this embodiment, a pressure database 82A is stored in the storage device 82 of the printer 13 to determine the pressure value, as shown in FIG. 5. In the pressure database 82A, conditional parameters, such as the magnitude of the pressing force, and the thickness, width, basis weight and flute type of the corrugated paperboard sheet SH, are associated with the pressure value. The user inputs or selects values of these parameters such as the pressing force and the thickness, through the manipulation unit 83. The control device 81 operates to determine the pressure value based on the pressure database 82A, using the pressing force, etc., input through the manipulation unit 83. The control device 81 controls the low-pressure air supply unit 245 or the high-pressure air supply unit 246 to compress air at the determined pressure value. This makes it possible to adjust the pressing force according to the magnitude of the pressing force desired by the user and the thickness, etc., of a corrugated paperboard sheet SH to be printed.

Further, the printer 13 may be configured not to allow the user to adjust the pressure of compressed air to be suppled from the low-pressure air supply unit 245 and the high-pressure air supply unit 246. For example, the printer 13 may be configured such that the manipulation unit 83 is incapable of accepting an input for changing the pressure value, and the pressure reducing valves 245A, 246A are not arranged in a location where the user can manipulate them. Further, the printer 13 may be configured such that the pressure value of compressed air to be supplied from the low-pressure and high-pressure air supply units 245, 246 to each of the air cylinders 251 to 260 can be changed with respect to each air cylinder (individually). For example, the printer 13 may be configured such that the low-pressure air supply unit 245 and the high-pressure air supply unit 246 are provided, respectively, with six pressure reducing valves 245A and four pressure reducing valves 246A (total ten pressure reducing valves), and the ten pressure reducing valves 245A, 246A are controlled by the control device 81, individually. In this case, the control device 81 may be configured to determine, based on a manipulated input to the manipulation unit 83, the pressure value of compressed air for each of the air cylinders 251 to 260, and control, based on the determined pressure value, a corresponding one of the pressure reducing valves 245A, 246A, independently, to change the pressing force of a corresponding one of the pressing areas 273. This makes it possible for the user to change the pressing forces to be applied from respective ones of the air cylinders 251 to 260 to the chamber frame 63, individually.

Further, the printer 13 may be configured to accept information about setting of the pressure value or an instruction for changing of the pressure value, from other device such as the management device 19. For example, the printer 13 may be configured to, at the time of order change in which the type of corrugated paperboard sheet SH or the content of printing is changed, acquire a desired pressure value from the management device 19, and control the pressure reducing valves 245A, 246A based on the acquired pressure value to change the pressure value. Alternatively, the printer 13 may be configured to acquire a value of the pressing force, a value of the thickness of the corrugated paperboard sheet, etc., from the management device 19, and determine the pressure value based on the pressure database 82A.

(Pressing Control During Printing)

Next, control of the pressing device 243 during printing will be described. In this embodiment, control information associated with an instruction for printing to be executed (hereinafter referred to occasionally as "order") is sent from the management device 19 to the printer 13. The control device 81 of the printer 13 starts to execute the order, based on the acquired control information. The control device 81 controls the roll drive motor group 87 according to a value of the conveyance speed in the acquired control information to rotate the printing roll 31, the press roll 32 and the anilox roll 35 at a given speed. During printing, the printing roll 31, the press roll 32 and the anilox roll 35 are rotated in respective rotation directions indicated by the arrowed lines in FIG. 2.

Upon start of the execution of the order, the control device 81 controls the cylinder air supply device 119 to close the coupling port valves 115, 116, 129, 131, 157, 158. The control device 81 also operates to close the bypass solenoid valve 103, and to close the cleaning water supply solenoid valves 161 to 168. Further, the control device 81 controls the three-way switching solenoid valve 96 to switch the three-way switching solenoid valve 96 to a state in which the coupling port 75 is communicated with the ink supply pipe 93. In this process, the control device 81 controls the ink pipe moving mechanism 139 to move the cleaning unit 149 to a standby position.

In this embodiment, the control device 81 operates to normally rotate the supply pump 89, and reversely rotate the recovery pump 125. The supply pump 89 sends the ink 70 in the ink can 91 from the ink supply pipe 92 toward the ink supply pipe 93. The recovery pipe 125 starts an operation of sending the ink 70 in the recovery pipe 123 toward the recovery pipe 124. During printing, the supply pump 89 is normally rotated, and the recovery pump 125 is reversely rotated. According to the normal rotation of the supply pump 89, the ink 70 in the ink can 91 is supplied to the ink reservoir 63A, via the ink supply pipes 92, 93, 94 and the coupling port 75. The ink 70 supplied to the ink reservoir 63A is reserved to reach an ink amount corresponding to the height position of the coupling ports 71, 79. The ink 70 further flowing into the coupling ports 71, 79 is recovered as surplus ink into the ink can 91 via the surplus ink recovery pipes 133, 135, the ink pans 105, 106, etc.

Further, the control device 81 operates to drive the low-pressure air supply unit 245 and the high-pressure air supply unit 246 to generate compressed air. In this embodiment, the control device 81 controls the low-pressure air supply unit 245 and the high-pressure air supply unit 246 to generate compressed air at a pressure value determined based on the aforementioned input values from the user and the pressure database 82A. The control device 81 operates to open the solenoid valves of the low-pressure air supply unit 245 and the high-pressure air supply unit 246 to start supply of compressed air. The low-pressure air supply unit 245 supplies low-pressure compressed air to the air cylinders 251 to 253, 358 to 260. The high-pressure air supply unit 246 supplies high-pressure compressed air to the air cylinders 254 to 257. Each of the air cylinders 251 to 260 presses the chamber frame 63 toward the anilox roll 35 by the first pressing force or second pressing force set to a given value. Thus, the front-rear directional central region of the chamber frame 63 is pressed by the second pressing force which is greater than the first pressing force for the outer region thereof.

Upon completion of preparation for downstream devices such as the printer 13, the feeder 11 sequentially feeds out corrugated paperboard sheets SH. The way to confirm whether the preparation for the downstream devices is completed is not particularly limited. For example, the management device 19 may be configured to confirm the completion of the preparation for the downstream devices, and inform the control device 81 of the completion of the preparation. Alternatively, the completion of preparation for the downstream devices may be determined when a certain period of time has elapsed since an instruction for starting the execution of the order was issued.

When the printer 13 performs printing to the corrugated paperboard sheet SH, a load is applied to the printing roll 31, etc., from the corrugated paperboard sheet SH. However, since the chamber frame 63 is applied with the pressing forces by the pressing device 243, bending or vibration thereof is suppressed. This makes it possible to allow the distal end of the doctor blade 65 to come into contact with the anilox roll 35 evenly at respective positions in the front-rear direction. It is also possible to uniform the thickness of the ink 70 transferred onto the anilox roll 35, thereby accurately performing printing.

Then, the corrugated paperboard sheets SH will be fed out from the feeder 11 one by one until the number of printed corrugated paperboard sheets reaches a sheet number specified in the control information of the order. When the printer performs printing to the last corrugated paperboard sheet SH, and the die-cutter 18 completes the processing of said last corrugated paperboard sheet SH, printing and professing corresponding to the one order are completed.

In this embodiment, the control device 81 is configured to control the pressing device 243 to, during execution of one order to perform printing to a plurality of corrugated paperboard sheets SH, maintain the first pressing force and the second pressing force at respective given values set before the printing. Specifically, the control device 81 is configured to control the pressing device 243 to keep the pressure value of compressed air generated by each of the low-pressure and high-pressure air supply units 245, 246 constant to maintain each of the first and second pressing forces constant, during execution of the one order, Here, as a result of repeatedly performing printing, the doctor blade 65 is worn away due to contact with the anilox roll 35. Wear of the doctor blade 65 causes a problem that scraping of the ink 70 by the doctor blade 65 becomes insufficient, and thus the thickness of the ink 70 on the anilox roll 35 becomes larger. Therefore, the control device 81 controls the pressing device 243 to increase the magnitude of each of the first pressing force and the second pressing force, according to the elapse of a wear period during which the doctor blade 65 is worn away. Specifically, the control device 81 operates to maintain the pressure of compressed air from each of the low-pressure and high-pressure air supply units 245, 246 at a given value, during execution of printing for one order. Further, every time printing for one order is completed, the control device 81 executes control of increasing the pressure value of each of the low-pressure and high-pressure air supply units 245, 246, and then operates to perform printing for the next order while maintaining the increase pressure value.

In this embodiment, pressure values corresponding to the number of times of execution of order are stored in the pressure database 82A. Specifically, the stored pressure values are set such that as the number of times of the execution increases, a corresponding pressure value becomes larger. The control device 81 operates to, every time execution of one order is completed, check the pressure database 82A, and increase the pressure value of compressed air from each of the low-pressure and high-pressure air supply units 245, 246 up to the checked value. This makes it possible to increase the magnitude of each of the first pressing force and the second pressing force, according to the elapse of the wear period during which the doctor blade 65 is worn away.

Here, the way to increase each of the first pressing force and the second pressing force is not limited to the above-mentioned technique. For example, the control device 81 may be configured to increase the pressure value of compressed air from one of the low-pressure and high-pressure air supply units 245, 246, i.e., increase only one of the first and second pressing forces, according to the number of times of execution of order. Alternatively, the control device 81 may be configured to change each of the first and second pressing forces according to the number of printed corrugated paperboard sheets. In this case, the control device 81 may be configured to count the number of printed corrugated paperboard sheets for a doctor blade 65 being currently used. When receiving a manipulated input indicating that the doctor blade 65 has been replaced with a new one, through the manipulation unit 83, the control device 81 operates to reset the previously-counted number, and restart counting the number of printed corrugated paperboard sheets. Further, pressure values corresponding to the number of printed corrugated paperboard sheets may be stored in the pressure database 82A. In this case, the control device 81 operates to check the pressure database 82A, every time the number of printed corrugated paperboard sheets increases, and when the number of printed corrugated paperboard sheets reaches a given value at which the pressure value should be increased, increase the pressure value of compressed air from each of the low-pressure and high-pressure air supply units 245, 246 up to a corresponding pressure value stored in the pressure database 82A. This also makes it possible to increase the magnitude of each of the first and second pressing forces, according to the elapse of the wear period during which the doctor blade 65 is worn away.

Alternatively, the control device 81 may be configured to measure a usage period (period of time from replacement) of the doctor blade 65, and increase each of the first and second pressing forces, according to the elapse of the usage period. Further, the control device 81 may be configured to adjust the pressure value by multiplying a value for adjusting the pressure value of compressed air from each of the low-pressure and high-pressure air supply units 245, 246 by a coefficient or the like, according to the number of printed corrugated paperboard sheets, or the usage period.

It should be noted that the first and second pressing forces do not have to be increased according to the elapse of the wear period during which the doctor blade 65 is worn away. For example, as an initial value of the pressure value of compressed air from each of the low-pressure and high-pressure air supply units 245, 246, a pressure value (high pressure value) may be set which is capable of suppressing bending or vibration of the chamber frame 63 to allow the doctor blade 65 after being worm away to come into contact with the anilox roll 35 even after the wear period during which the doctor blade 65 is worn away has been elapsed. More specifically, as an initial value of the pressure value of compressed air from each of the low-pressure and high-pressure air supply units 245, 246, a high pressure value may be set which is capable of allowing the doctor blade 65 after being worm away to adequately come into contact with the anilox roll 35 even after the doctor blade 65 is used and worn away until it needs to be replaced, i.e., a value may be set which is capable of establishing the contact in a state in which wear of the doctor blade 65 has been most progressed.

In the above embodiment, each of the air cylinders 251 to 260 is one example of "fluid cylinder". Each of the low-pressure air supply unit 245 the high-pressure air supply unit 246 is one example of "adjuster". The control device 81 and the pressure database 82A are one example of "pressing force control means". The manipulation unit 83 is one example of "pressing force control means" or "acceptance part". Each of the creaser 15, the slotter 17 and the die-cutter 18 is one example of "processing unit".

The above embodiment brings out the following advantageous effect.

(1) The printer 13 in the above embodiment comprises: a chamber 33 which reserves ink 70; an anilox roll 35 onto which the ink 70 is transferred from the chamber 33; a printing roll 31 provided with a printing plate 37, and configured to allow the ink 70 to be transferred from the anilox roll 35 onto the printing plate 37, and then transfer the ink 70 on the printing plate 37 onto a corrugated paperboard sheet SH to print the corrugated paperboard sheet SH; and a pressing device 243 for applying a pressing force to press the chamber 33 toward the anilox roll 35. The chamber 33 comprises: a chamber frame 63 which reserves the ink 70; and a doctor blade 65 attached to the chamber frame 63 and configured to scrape the ink 70 transferred onto the anilox roll 35 to adjust a thickness of the ink 70 after the transfer. The pressing device 243 is configured to apply a first pressing force, and a second pressing force which is greater than the first pressing force, respectively, to a first pressing areas 273A and a second pressing area 273B in a back surface (left surface) of the chamber frame 63. In a state in which no pressing force is applied by the pressing device 243, bending occurring in the chamber frame 63 due to a load transmitted from the printing roll 31 to the chamber frame 63 via the anilox roll 35 as printing is performed to the corrugated paperboard sheet SH is greater in the second pressing area 273B than in the first pressing area 273A.

According to the above feature, an amount of ink to be scraped by the doctor blade 65 from the ink 70 transferred onto the anilox roll 35 can be adjusted by pressing the first pressing area 273A and the second pressing area 373B by the pressing device 243. Further, the second pressing force greater than the first pressing force is applied to the second pressing area 273B in which bending of the chamber frame 63 is greater than that in the first pressing area. By pressing the chamber frame 63 toward the anilox roll 35, it becomes possible to suppress bending or vibration of the chamber frame 63, and more evenly flatten the thickness of the ink 70 transferred onto the anilox roll 35 by the doctor blade 65. This makes it possible to reduce an influence of bending or the like of the chamber frame 63 and more evenly transfer the ink 70 onto the corrugated paperboard sheet SH via the printing plate 37 of the printing roll 31, thereby improving printing accuracy.

(2) In the above printer 13, the pressing device 243 comprises: ten air cylinders 251 to 260 provided, respectively, in the ten pressing area 273, and each capable of changing a pressing force to press the chamber frame 63 according to a pressure of air (which is one example of "fluid" set forth in the appended claims); and a low-pressure air supply unit 245 and a high-pressure air supply unit 246 for adjusting the pressure of compressed air from each of the air cylinders 251 to 260.

According to this feature, the air cylinders 251 to 260 are used as the pressing device 243, so that it becomes possible to adjust the first pressing force and the second pressing force within a relatively short period of time. Thus, when the corrugated paperboard sheet SH to be printed and the printing plate 37 are changed in connection with order change, so that the load to be transferred changes, and thereby bending or the like of the chamber frame 63 changes, it becomes possible to adjust the first and second pressing forces to respective desired values, i.e., values which allow the doctor blade 65 to come into contact with the anilox roll 35 evenly, within a short period of time for order change work.

(3) In the above printer 13, the chamber frame 63 extends along a front-rear direction (which is one example of "width direction of the printer" set forth in the appended claims). The pressing device 243 is configured to press the chamber frame 63 in a plurality of pressing areas 273 aligned in the front-rear direction. The second pressing area 273B is composed of two or more central pressing areas 273 among the plurality of pressing areas 273 aligned in the front-rear direction. The first pressing area 273A is composed of at least one pair of pressing areas 273 among the plurality of pressing areas 273 aligned in the front-rear direction, wherein the at least one pair of pressing areas 273 are arranged to interpose the second pressing area 273A therebetween in the front-rear direction, and located, respectively, in opposite end regions of the chamber frame 63 in the front-rear direction. That is, in the above embodiment, as "opposite end regions of the chamber frame in the width direction of the printer" set forth in the appended claims, a portion of the chamber frame 63 which is outer regions on both sides of the front-rear directional central region of the chamber frame 63 i.e., a certain region interposing the central region therebetween, is employed. However, the "opposite end regions of the chamber frame in the width direction of the printer" set forth in the appended claims is not limited to the certain region interposing the central region therebetween, but may be endmost areas of the chamber frame 63, specifically front-rear directional opposite ends of the chamber frame 63. In this case, the first pressing area 273A to which a relatively small pressing force is applied is composed only of endmost areas of the chamber frame 63 (composed of two pressing areas at opposite ends of the chamber frame 63), and a central region other than the opposite ends may be used for the second pressing area 273B.

The front-rear directional central region of the printer corresponds to a location where the corrugated paperboard sheet SH is conveyed, and therefore a load to be applied from the corrugated paperboard sheet SH to the printing roll 31, etc., becomes larger, irrespective of the magnitude of the widthwise dimension of the corrugated paperboard sheet SH. Therefore, bending or the like of the chamber frame 63 becomes lager in the front-rear directional central region of the chamber frame 63. Further, if the doctor blade 65 receives a larger load in a front-rear directional central region thereof, it is likely to be more worm away in the central region. Therefore, the high-pressure pressing area 273B is set in the front-rear directional central region of the chamber frame 63, and the low-pressure second pressing area 273A is set in each of the front-rear directional outer end regions. According to the above feature, when the pressing force is applied in the plurality of pressing areas 273, the pressing force is set to be greater in the central region of the chamber frame 63 than in the opposite end regions the chamber frame 63, so that it becomes possible to allow the doctor blade 65 to come into contact with the ink 70 on the anilox roll 35.

(4) In the above printer 13, the first pressing area 273A and the second pressing area 273B are arranged in a location which is a middle of the chamber frame 63 in an up-down direction (FIG. 13). According to this feature, the up-down directional middle of the chamber frame 63 is pressed from a back surface thereof, so that it becomes possible to efficiently apply the pressing force from the pressing device 243 to the entire chamber frame 63.

(5) The above printer 13 may be configured such that the first pressing area 273A and the second pressing area 273B are arranged in a location opposed to the doctor blade 65 across the chamber frame 63, in a conveyance direction FD (right-left direction) along which the corrugated paperboard sheet SH is conveyed (FIG. 14). According to this feature, the pressing device 243 presses the chamber frame 63 from the back surface thereof in the location opposed to the doctor blade 65 across the chamber frame 63 in the right-left direction. This makes it possible to efficiently apply the pressing force from the pressing device 243 to the chamber frame 63 to allow the doctor blade 65 to come into contact with the ink 70 of the anilox roll 35 evenly.

(6) In the above printer 13, the pressing device 243 is configured to maintain the first pressing force and the second pressing force at respective given values, during an operation of performing printing to a plurality of the corrugated paperboard sheets SH. According to this feature, the first pressing force and the second pressing force are maintained constant, irrespective of the magnitude of bending of the chamber frame 63, i.e., the magnitude of a load to be applied to the chamber frame 63, etc. This makes it possible to eliminate the need for the user to consider or adjust the pressing force, thereby improving usability while improving printing accuracy.

(7) In the above printer 13, the pressing device 243 is configured to increase the magnitude of each of the first pressing force and the second pressing force, according to the elapse of a wear period during which the doctor blade 65 is worn away. If the pressing operation is continued by the first pressing force and the second pressing force each kept constant, the thickness of the ink 70 on the anilox roll 35 is likely to change due to wear of the doctor blade 65. According to the above feature, each of the first pressing force and the second pressing force is increased according to the progress of wear of the doctor blade 65, so that it becomes possible to suppress a change in the thickness of ink due to the progress of the wear.

(8) The above printer 13 comprises, as pressing force control means to change the magnitude of each of the first pressing force and the second pressing force, a pressure database 82A, a control device 81 and a manipulation unit 83. The magnitude of a load applied from the corrugated board sheet SH to the printing roll 31 varies depending on various parameters such as the thickness of the corrugated board sheet SH to be printed, and therefore bending or vibration occurring in the chamber frame 63 due to the load also varies depending on the various parameters. The control device 81 can adjust the first pressing force and the second pressing force to respective values appropriate to bending or the like varying depending on the various parameters, based on information associated with changing of the first and second pressing forces, such as input values from the manipulation unit 83 and data in the pressure database 82A. This makes it possible to obtain a desired printing result, irrespective of changes of the parameters such as the thickness of the corrugated board sheet SH to be printed.

(9) The above printer 13 further comprises, as the pressing force control means, a manipulation unit 83 to accept at least one of values of the first pressing force and the second pressing force, a value of the thickness of the corrugated paperboard sheet SH to be printed, a value of the width of the corrugated paperboard sheet SH along the front-rear direction, a value of the basis weight of the corrugated paperboard sheet SH, and a flute type of the corrugated paperboard sheet SH, wherein the control device 81 is operable, based on the accepted information, to set the magnitude of each of the first pressing force and the second pressing force in the pressing device.

According to this feature, information about at least one of values of the first and second pressing forces, and the thickness, width, basis weight and flute type of the corrugated paperboard sheet SH is accepted by the manipulation unit 83. The control device 81 adjust each of the first and second pressing forces, based on the information about at least one parameters accepted by the manipulation unit 83. Thus, it becomes possible to adjust the magnitude of each of the first and second pressing forces, while also taking into account information about the thickness, width, basis weight and flute type of the corrugated paperboard sheet SH, thereby obtaining a desired printing result. It should be noted here that the acceptance part to accept information about at least one of the parameters is not limited to the manipulation unit 83. For example, the control device 81 may be configured to accept information about at least one of the parameters from the management device 19. In this case, a communication interface of the control device 81 connectable to the management device 19 is one example of "acceptance part" set force in the appended claims. Further, the control device 81 may be configured to change each (pressure value) of the first and second pressing forces, based on information other than the above-mentioned information. For example, the control device 81 may be configured change each of the first and second pressing forces, based on the structure (the number of layers, single-faced structure, double-faced structure, etc.) of the corrugated board sheet SH, the material of the printing roll 31 or the anilox roll 35, the material and hardness of the doctor blade 65, etc.

It should be understood that the present invention is not limited to the above embodiment, but various changes and modifications may be made therein without departing from the spirit and scope thereof as set forth in appended claims.

For example, although not particularly mentioned in the above embodiment, the corrugated paperboard printer in the above embodiment may be a fixed printer in which a space for replacing the printing plate 37 attached to the printing roll (permanent space such as a stair or a work area) is ensured, or may be a so-called openable printer in which no replacement space is provided, and in an operation of replacing the printing plate, a user enters a space ensured by sliding the printer 13 or the like in such a manner as to be opened in the right-left direction, and replaces the printing plate 37.

Further, the printer 13 in the above embodiment is one example. For example, the printer 13 needs not have a high-pressure cleaning function such as the recovery high-pressure air supply device 98. In this case, the printer 13 may be configured to clean the ink 70 remaining in the recovery pipes such as the recovery pipe 124, only by the cleaning water WT. Further, the printer 13 needs not have a function of cleaning the surplus ink recovery pipes 133, 135 by the cleaning water WT through the leaning water supply solenoid valves 161, 168. In this case, the printer 13 mat be configured to recover the ink 70 remaining in the surplus ink recovery pipes 133, 135, by high-pressure air from the recovery high-pressure air supply device 98

In the above embodiment, I-section steel is employed as the steel member. However, the steel member is not limited to I-section steel. The steel member to be used in the present invention may be H-section steel, or may be C-section steel (channel steel) as shown in FIGS. 9 and 10 as a comparative example. That is, the pressing device 243 may be attached to a structure of C-section steel as shown in FIGS. 9 and 10.

The plurality of pressing areas 273 need not be aligned in the front-rear direction. Further, the number of the pressing areas 273 is not limited to 10, but may be any other suitable plural number. Further, the pressing areas 273 may be composed of a plurality of sets of two pressing areas 273 aligned along the up-down direction.

The chamber frame 63 may have a structure divided in the front-rear direction (width direction of the printer). In this case, among a plurality of chamber frames 63, adjacent two chamber frames 63 in the front-rear direction may be arranged at respective positions offset in the up-down direction (such that they are not aligned in the front-rear direction).

The pressing device 243 may be configured to maintain the pressure value of compressed air from each of the low-pressure air supply unit 245 and the high-pressure air supply unit 246, irrespective of the number of times of execution of order or the number of printed corrugated board sheets. That is, the pressing device 243 may be configured to maintain the pressure value, irrespective of the elapse of the wear period of the doctor blade 65.

The steel member 67 may be a single member extending in the front-rear direction, or may be a plurality of members extending in the front-rear direction. For example, the steel member 67 may be composed of a plurality of members divided in the front-rear direction, and connected to each other by bolts or the like.

Although the steel member 67 in the above embodiment is disposed to extend from one end to the other end of the chamber frame 63 in the front-rear direction and cover the entire back surface of the chamber frame 63, the steel member usable in the present invention is not limited thereto. For example, the steel member 67 may be formed such that it is disposed opposed to only a front-rear directional central region of the chamber frame 63.

Although the steel member 67 in the above embodiment is disposed to extend from the upper end to the lower end of the chamber frame 63 in the up-down direction, the steel member usable in the present invention is not limited thereto. For example, the steel member 67 may be formed such that it is disposed opposed to only a lower region of the chamber frame 63.

The steel member 67 may be configured to have at least one of the insertion parts 211 to 217 for allowing one or more of the recovery pipes 109, 111, 121, 122, the surplus ink recovery pipes 133, 135, the drain pipes 153, 154 and the ink supply pipe 93 to be inserted thereinto.

The shape and size of the maintenance opening are not limited to those of the maintenance openings 181 to 187 in the above embodiment. For example, although each of the maintenance openings 181 to 187 in the above embodiment is formed in a size extending outwardly beyond the region surrounded by the heads of the plurality of screwing members 193, when viewing the chamber frame 63 from the side of the back surface thereof (FIG. 8), it is not limited thereto. For example, each of the maintenance openings 181 to 187 may be formed in a size smaller than a region surrounded by lines each connecting the heads of an adjacent pair of screwing members 193 among the four screwing members 193 illustrated in FIG. 8.

Further, the shape of each of the maintenance openings 181 to 187 may be any suitable shape such as a rectangular shape, a square shape, a circular shape, or an elliptical shape.

The doctor blade 65 may be attached to an intermediate position or upper position of the chamber frame 63 in the up-down direction.

An installation position of the rod members 69 is not limited to a position located just above and spaced apart from the liquid level of the ink 70 reserved in the ink reservoir 63A, but may be a position in contact with the liquid level.

The shape of each of the rod members 69 is not limited to a circular cylinder shape, but may be any other suitable shape.

The printer 13 may be devoid of a device for cleaning the anilox roll 35, etc., such as the cleaning unit 149 and the ink pipe moving mechanism 139.

What is claimed is:

1. A corrugated paperboard printer comprising:

a chamber which reserves ink;

an anilox roll onto which the ink is transferred from the chamber;

a printing roll provided with a printing plate, the printing roll being configured to allow the ink to be transferred from the anilox roll onto the printing plate, and transfer the ink on the printing plate onto a corrugated paperboard sheet to print the corrugated paperboard sheet; and a pressing device is configured to apply a pressing force to press the chamber toward the anilox roll;

wherein the chamber comprises:

a chamber frame which reserves the ink; and a doctor blade attached to the chamber frame and configured to scrape the ink transferred onto the anilox roll to adjust a thickness of the ink after the transfer; and wherein the pressing device is configured to apply a first pressing force, and a second pressing force which is greater than the first pressing force, respectively, to a first pressing area and a second pressing area in a back surface of the chamber frame, wherein in a state in which no pressing force is applied by the pressing device, bending occurring in the chamber frame due to a load transmitted from the printing roll to the chamber frame via the anilox roll as printing is performed to the corrugated paperboard sheet is greater in the second pressing area than in the first pressing area.

2. The corrugated paperboard printer as recited in claim 1, wherein the pressing device comprises:

at least two fluid cylinders provided, respectively, in the first pressing area and the second pressing area, and each capable of changing a pressing force to press the chamber frame according to a pressure of fluid; and an adjuster configured to adjust the fluid pressure of each of the fluid cylinders.

3. The corrugated paperboard printer as recited in claim 1, wherein:

the chamber frame extends along a width direction of the corrugated paperboard printer; and the pressing device is configured to press the chamber frame in a plurality of pressing areas aligned in the width direction of the printer, wherein the second pressing area is composed of two or more central pressing areas among the plurality of pressing areas aligned in the width direction of the printer, and the first pressing area is composed of at least one pair of pressing areas among the plurality of pressing areas aligned in the width direction of the printer, the at least one pair of pressing areas being arranged to interpose the second pressing area therebetween in the width direction of the printer, and located, respectively, in opposite end regions of the chamber frame in the width direction of the printer.

4. The corrugated paperboard printer as recited in claim 1, wherein the first pressing area and the second pressing area are arranged in a location which is a middle of the chamber frame in an up-down direction.

5. The corrugated paperboard printer as recited in claim 1, wherein the first pressing area and the second pressing area are arranged in a location opposed to the doctor blade across the chamber frame, in a conveyance direction along which the corrugated paperboard sheet is conveyed.

6. The corrugated paperboard printer as recited in claim 1, wherein the pressing device is configured to maintain the first pressing force and the second pressing force at respective given values, during an operation of performing printing to a plurality of the corrugated paperboard sheets.

7. The corrugated paperboard printer as recited in claim 1, wherein the pressing device is configured to increase a magnitude of each of the first pressing force and the second pressing force, according to an elapse of a wear period during which the doctor blade is worn away.

8. The corrugated paperboard printer as recited in claim 1, which further comprises pressing force control means to change a magnitude of each of the first pressing force and the second pressing force.

9. The corrugated paperboard printer as recited in claim 8, wherein the pressing force control means comprises an acceptance part to accept at least one of values of the first pressing force and the second pressing force, a value of a thickness of the corrugated paperboard sheet to be printed, a value of a width of the corrugated paperboard sheet along a width direction of the corrugated paperboard sheet, a value of a basis weight of the corrugated paperboard sheet, and a flute type of the corrugated paperboard sheet, wherein the pressing force control means is operable, based on the accepted information, to set the magnitude of each of the first pressing force and the second pressing force in the pressing device.

10. A corrugated paperboard box making machine comprising:

the corrugated paperboard printer as recited in claim 1;

a corrugated paperboard feeder for feeding the corrugated paperboard sheet to the corrugated paperboard printer; and a processing unit configured to perform processing to the corrugated paperboard sheet to which printing has been performed by the corrugated paperboard printer.

* * * * *